US010163406B2

(12) United States Patent
Sim et al.

(10) Patent No.: US 10,163,406 B2
(45) Date of Patent: Dec. 25, 2018

(54) ELECTRO-OPTIC DISPLAYS DISPLAYING IN DARK MODE AND LIGHT MODE, AND RELATED APPARATUS AND METHODS

(71) Applicant: E Ink Corporation, Billerica, MA (US)

(72) Inventors: Teck Ping Sim, Acton, MA (US); Pierre-Yves Emelie, Arlington, MA (US); Kenneth R. Crounse, Somerville, MA (US); Yuval Ben-Dov, Cambridge, MA (US)

(73) Assignee: E Ink Corporation, Billerica, MA (US)

( * ) Notice: Subject to any disclaimer, the term of this patent is extended or adjusted under 35 U.S.C. 154(b) by 32 days.

(21) Appl. No.: 15/015,822

(22) Filed: Feb. 4, 2016

(65) Prior Publication Data

US 2016/0225322 A1 Aug. 4, 2016

Related U.S. Application Data

(60) Provisional application No. 62/112,060, filed on Feb. 4, 2015, provisional application No. 62/184,076, filed on Jun. 24, 2015.

(51) Int. Cl.

| | |
|---|---|
| ***G09G 3/34*** | (2006.01) |
| ***G09G 3/20*** | (2006.01) |
| ***G09G 5/02*** | (2006.01) |

(52) U.S. Cl.

CPC ..... *G09G 3/344* (2013.01); *G09G 5/024* (2013.01); *G09G 2320/0214* (2013.01); *G09G 2320/0257* (2013.01)

(58) Field of Classification Search

CPC ..... G09G 3/344; G09G 2310/06; G09G 2310/062; G09G 2310/063;

(Continued)

(56) References Cited

U.S. PATENT DOCUMENTS

| | | | |
|---|---|---|---|
| 4,418,346 | A | 11/1983 | Batchelder |
| 5,760,761 | A | 6/1998 | Sheridon |

(Continued)

FOREIGN PATENT DOCUMENTS

| | | | |
|---|---|---|---|
| JP | 2007047208 | A | 2/2007 |
| JP | 2011053580 | A | 3/2011 |

(Continued)

OTHER PUBLICATIONS

Wood, D., "An Electrochromic Renaissance?" Information Display, 18(3), (Mar. 24, 2002) Mar. 1, 2002.

(Continued)

*Primary Examiner* — Bryan Earles
(74) *Attorney, Agent, or Firm* — Zhen Bao

(57) ABSTRACT

This invention provides methods of and related apparatus for driving an electro-optic display having a plurality of pixels to display white text on a black background ("dark mode") while reducing edge artifacts, ghosting and flashy updates. The present invention reduces the accumulation of edge artifacts by applying a special waveform transition to edge regions according to an algorithm along with methods to manage the DC imbalance introduced by the special transition. Edge artifact clearing may be achieved by identifying specific edge pixels to receive a special transition called an inverted top-off pulse ("iTop Pulse") and, since the iTop Pulse is DC imbalanced, to subsequently discharge remnant voltage from the display. This invention further provides methods of and related apparatus for driving an electro-optic display having a plurality of pixels to display white text on a black background ("dark mode") while reducing the appearance of ghosting due to edge artifacts and flashy updates by identifying specific edge pixels to receive a special transition called an inverted Full Pulse transition ("iFull Pulse").

15 Claims, 14 Drawing Sheets

(58) Field of Classification Search
CPC ..... G09G 2310/068; G09G 2320/0204; G09G 2320/0209; G09G 2320/0257
See application file for complete search history.

(56) References Cited

U.S. PATENT DOCUMENTS 5,777,782 A 7/1998 Sheridon
5,808,783 A 9/1998 Crowley
5,872,552 A 2/1999 Gordon, II
5,930,026 A 7/1999 Jacobson
6,054,071 A 4/2000 Mikkelsen, Jr.
6,055,091 A 4/2000 Sheridon
6,097,531 A 8/2000 Sheridon
6,128,124 A 10/2000 Silverman
6,130,774 A 10/2000 Albert
6,137,467 A 10/2000 Sheridon
6,144,361 A 11/2000 Gordon, II
6,147,791 A 11/2000 Sheridon
6,172,798 B1 1/2001 Albert
6,184,856 B1 2/2001 Gordon, II
6,225,971 B1 5/2001 Gordon, II
6,241,921 B1 6/2001 Jacobson
6,271,823 B1 8/2001 Gordon, II
6,301,038 B1 10/2001 Fitzmaurice
6,445,489 B1 9/2002 Jacobson
6,504,524 B1 1/2003 Gates
6,512,354 B2 1/2003 Jacobson
6,531,997 B1 3/2003 Gates
6,672,921 B1 1/2004 Liang
6,704,133 B2 3/2004 Gates
6,738,050 B2 5/2004 Comiskey
6,753,999 B2 6/2004 Zehner
6,762,744 B2 7/2004 Katase
6,788,449 B2 9/2004 Liang
6,825,970 B2 11/2004 Goenaga
6,866,760 B2 3/2005 Paolini, Jr.
6,870,657 B1 3/2005 Fitzmaurice
6,900,851 B2 5/2005 Morrison
6,922,276 B2 7/2005 Zhang et al.
6,950,220 B2 9/2005 Abramson et al.
6,982,178 B2 1/2006 LeCain et al.
6,995,550 B2 2/2006 Jacobson
7,002,728 B2 2/2006 Pullen et al.
7,012,600 B2 3/2006 Zehner
7,023,420 B2 4/2006 Comiskey
7,034,783 B2 4/2006 Gates
7,061,166 B2 6/2006 Kuniyasu
7,061,662 B2 6/2006 Chung
7,075,502 B1 7/2006 Drzaic
7,116,318 B2 10/2006 Amundson et al.
7,116,466 B2 10/2006 Whitesides
7,119,772 B2 10/2006 Amundson
7,170,670 B2 1/2007 Webber
7,177,066 B2 2/2007 Chung
7,193,625 B2 3/2007 Danner
7,197,174 B1 3/2007 Koizumi
7,202,847 B2 4/2007 Gates
7,236,291 B2 6/2007 Kaga et al.
7,242,514 B2 7/2007 Chung
7,259,744 B2 8/2007 Arango
7,304,787 B2 12/2007 Whitesides
7,312,784 B2 12/2007 Baucom et al.
7,312,794 B2 12/2007 Zehner
7,321,459 B2 1/2008 Masuda et al.
7,327,511 B2 2/2008 Whitesides
7,339,715 B2 3/2008 Webber et al.
7,365,900 B2 4/2008 Yamamoto
7,408,699 B2 8/2008 Wang
7,411,719 B2 8/2008 Paolini, Jr. et al.
7,420,549 B2 9/2008 Jacobson
7,453,445 B2 11/2008 Amundson
7,492,339 B2 2/2009 Amundson
7,528,822 B2 5/2009 Amundson
7,535,624 B2 5/2009 Amundson et al.
7,545,358 B2 6/2009 Gates
7,557,984 B2 7/2009 Karasawa
7,583,251 B2 9/2009 Arango
7,602,374 B2 10/2009 Zehner
7,612,760 B2 11/2009 Kawai
7,679,599 B2 3/2010 Kawai
7,679,813 B2 3/2010 Liang
7,679,814 B2 3/2010 Paolini, Jr. et al.
7,683,606 B2 3/2010 Kang
7,688,297 B2 3/2010 Zehner
7,729,039 B2 6/2010 LeCain et al.
7,733,311 B2 6/2010 Amundson
7,733,335 B2 6/2010 Zehner
7,787,169 B2 8/2010 Abramson et al.
7,791,789 B2 9/2010 Albert
7,800,580 B2 9/2010 Johnson
7,839,564 B2 11/2010 Whitesides et al.
7,859,742 B1 12/2010 Chiu
7,952,557 B2 5/2011 Amundson
7,956,841 B2 6/2011 Albert
7,982,479 B2 7/2011 Wang
7,999,787 B2 8/2011 Amundson
8,009,348 B2 8/2011 Zehner
8,077,141 B2 12/2011 Duthaler
8,125,501 B2 2/2012 Amundson
8,139,050 B2 3/2012 Jacobson
8,174,490 B2 5/2012 Whitesides
8,243,013 B1 8/2012 Sprague
8,274,472 B1 9/2012 Wang
8,289,250 B2 10/2012 Zehner
8,295,592 B2 10/2012 Washio
8,300,006 B2 10/2012 Zhou
8,305,341 B2 11/2012 Arango
8,314,784 B2 11/2012 Ohkami
8,319,759 B2 11/2012 Jacobson
8,373,649 B2 2/2013 Low
8,384,658 B2 2/2013 Albert
8,456,414 B2 6/2013 Lin
8,514,168 B2 8/2013 Chung
8,519,994 B2 8/2013 Chiu et al.
8,537,105 B2 9/2013 Chiu
8,558,783 B2 10/2013 Wilcox
8,558,785 B2 10/2013 Zehner
8,558,786 B2 10/2013 Lin
8,558,855 B2 10/2013 Sprague
8,576,164 B2 11/2013 Sprague
8,576,259 B2 11/2013 Lin
8,593,396 B2 11/2013 Amundson
8,605,032 B2 12/2013 Liu
8,643,595 B2 2/2014 Chung
8,665,206 B2 3/2014 Lin
8,681,191 B2 3/2014 Yang
8,730,153 B2 5/2014 Sprague
8,810,525 B2 8/2014 Sprague
8,928,562 B2 1/2015 Gates
8,928,641 B2 1/2015 Chiu
8,970,640 B2 3/2015 Wang et al.
8,976,444 B2 3/2015 Zhang
9,013,394 B2 4/2015 Lin
9,019,197 B2 4/2015 Lin
9,019,198 B2 4/2015 Lin
9,019,318 B2 4/2015 Sprague
9,082,352 B2 7/2015 Cheng
9,171,508 B2 10/2015 Sprague
9,218,773 B2 12/2015 Sun
9,224,338 B2 12/2015 Chan
9,224,342 B2 12/2015 Sprague
9,224,344 B2 12/2015 Chung
9,230,492 B2 1/2016 Harrington
9,251,736 B2 2/2016 Lin
9,262,973 B2 2/2016 Wu
9,269,311 B2 2/2016 Amundson
9,280,939 B2 3/2016 Muto et al.
9,299,294 B2 3/2016 Lin
9,373,289 B2 6/2016 Sprague
9,390,066 B2 7/2016 Smith
9,390,661 B2 7/2016 Chiu
9,412,314 B2 8/2016 Amundson
9,460,666 B2 10/2016 Sprague
9,460,667 B2 10/2016 Bozarth et al.

(56) References Cited

U.S. PATENT DOCUMENTS

| | | | |
|---|---|---|---|
| 9,483,981 | B2 | 11/2016 | Letourneur et al. |
| 9,495,918 | B2 | 11/2016 | Harrington |
| 9,501,981 | B2 | 11/2016 | Lin |
| 9,513,743 | B2 | 12/2016 | Sjodin et al. |
| 9,514,667 | B2 | 12/2016 | Lin |
| 9,542,895 | B2 | 1/2017 | Gates |
| 9,564,088 | B2 | 2/2017 | Wilcox et al. |
| 9,612,502 | B2 | 4/2017 | Danner |
| 9,620,048 | B2 | 4/2017 | Sim |
| 9,620,067 | B2 | 4/2017 | Harrington |
| 9,672,766 | B2 | 6/2017 | Sjodin |
| 9,691,333 | B2 | 6/2017 | Cheng |
| 9,721,495 | B2 | 8/2017 | Harrington |
| 9,792,861 | B2 | 10/2017 | Chang |
| 9,792,862 | B2 | 10/2017 | Hung |
| 9,966,018 | B2 | 5/2018 | Gates |
| 2003/0102858 | A1 | 6/2003 | Jacobson |
| 2004/0246562 | A1 | 12/2004 | Chung |
| 2005/0253777 | A1 | 11/2005 | Zehner |
| 2007/0091418 | A1 | 4/2007 | Danner |
| 2007/0103427 | A1 | 5/2007 | Zhou et al. |
| 2007/0176912 | A1 | 8/2007 | Beames |
| 2008/0024429 | A1 | 1/2008 | Zehner |
| 2008/0024482 | A1 | 1/2008 | Gates |
| 2008/0094315 | A1 | 4/2008 | Johnson et al. |
| 2008/0136774 | A1 | 6/2008 | Harris |
| 2008/0291129 | A1 | 11/2008 | Harris |
| 2008/0303780 | A1 | 12/2008 | Sprague |
| 2009/0174651 | A1 | 7/2009 | Jacobson |
| 2009/0267970 | A1 | 10/2009 | Wong et al. |
| 2009/0322721 | A1 | 12/2009 | Zehner |
| 2010/0194733 | A1 | 8/2010 | Lin |
| 2010/0194789 | A1 | 8/2010 | Lin |
| 2010/0220121 | A1 | 9/2010 | Zehner |
| 2010/0265561 | A1 | 10/2010 | Gates et al. |
| 2011/0063314 | A1 | 3/2011 | Chiu |
| 2011/0175875 | A1 | 7/2011 | Lin |
| 2011/0193840 | A1 | 8/2011 | Amundson |
| 2011/0193841 | A1 | 8/2011 | Amundson |
| 2011/0199671 | A1 | 8/2011 | Amundson |
| 2011/0221740 | A1 | 9/2011 | Yang |
| 2012/0001957 | A1 | 1/2012 | Liu |
| 2012/0098740 | A1 | 4/2012 | Chiu |
| 2012/0139963 | A1* | 6/2012 | Lee ..... G09G 3/344 345/690 |
| 2013/0063333 | A1 | 3/2013 | Arango |
| 2013/0194250 | A1 | 8/2013 | Amundson et al. |
| 2013/0249782 | A1 | 9/2013 | Wu |
| 2014/0009817 | A1 | 1/2014 | Wilcox et al. |
| 2014/0078035 | A1 | 3/2014 | Sato et al. |
| 2014/0204012 | A1 | 7/2014 | Wu |
| 2014/0240210 | A1 | 8/2014 | Wu |
| 2014/0253425 | A1 | 9/2014 | Zalesky |
| 2014/0293398 | A1 | 10/2014 | Wang |
| 2014/0362131 | A1 | 12/2014 | Paolini, Jr. |
| 2015/0097877 | A1 | 4/2015 | Lin |
| 2015/0109358 | A1 | 4/2015 | Hills et al. |
| 2015/0262255 | A1 | 9/2015 | Khajehnouri |
| 2015/0262551 | A1 | 9/2015 | Zehner |
| 2016/0093253 | A1 | 3/2016 | Yang |
| 2016/0133196 | A1 | 5/2016 | Emelie et al. |
| 2016/0140910 | A1 | 5/2016 | Amundson |
| 2016/0180777 | A1 | 6/2016 | Lin |
| 2016/0225321 | A1 | 8/2016 | Sim et al. |

FOREIGN PATENT DOCUMENTS

| | | |
|---|---|---|
| WO | 2007032898 | 3/2007 |
| WO | 2013049286 | 4/2013 |

OTHER PUBLICATIONS

O'Regan, B. et al., "A Low Cost, High-efficiency Solar Cell Based on Dye-sensitized colloidal TiO2 Films", Nature, vol. 353, Oct. 24, 1991, 737-740 Oct. 24, 1991.

Bach, U., et al., "Nanomaterials-Based Electrochromics for Paper-Quality Displays", Adv. Mater, 14(11), 845 (2002) Jun. 5, 2002.

Hayes, R.A., et al., "Video-Speed Electronic Paper Based on Electrowetting", Nature, vol. 425, Sep. 25, pp. 383-385 (2003) Sep. 25, 2003.

Kitamura, T., et al., "Electrical toner movement for electronic paper-like display", Asia Display/IDW '01, p. 1517, Paper HCS1-1 (2001) Jan. 1, 2001.

Yamaguchi, Y., et al., "Toner display using insulative particles charged triboelectrically", Asia Display/IDW '01, p. 1729, Paper AMD4-4 (2001) Jan. 1, 2001.

PCT/US2016/018152; International Search Report and Written Opinion; Korean Intellectual Property Office, dated Jun. 1, 2016.

European Patent Office, EP Appl. No. 16747283.6, Extended European Search Report, dated Jun. 11, 2018. Jun. 11, 2018.

Korean Intellectual Property Office, PCT/US2016/016598, International Search Report and Written Opinion, dated May 12, 2016. May 12, 2016.

* cited by examiner

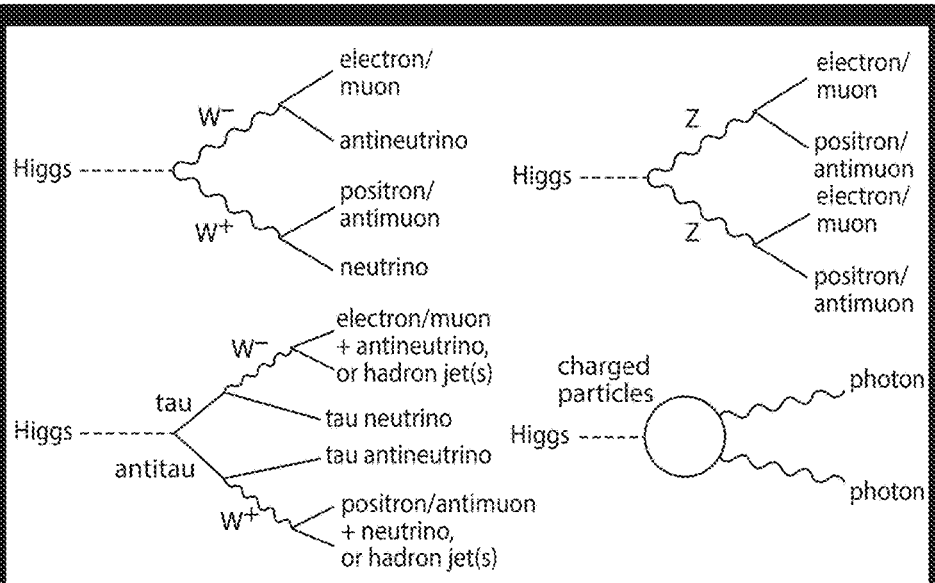

Four promising decay modes for discovering a Higgs boson at 125 GeV. The Higgs can decay into two W bosons, which then (sometimes) decay into electrons or muons and their neutrinos. Or it can decay into two Z bosons, which then (sometimes) decay into electrons or muons and their antiparticles. Or it can decay into a tau-antitau pair, which then decays into neutrinos and other fermions. Or it can decay into some charged particle that then converts into two photons. These are all rare processes but relatively easy to pick out at LHC experiments.

Fig. 12

ELECTRO-OPTIC DISPLAYS DISPLAYING IN DARK MODE AND LIGHT MODE, AND RELATED APPARATUS AND METHODS

REFERENCE TO RELATED APPLICATIONS

This application claims benefit of U.S. Provisional Application Ser. No. 62/112,060 filed on Feb. 4, 2015 and U.S. Provisional Application Ser. No. 62/184,076 filed on Jun. 24, 2015.

This application is related to U.S. Pat. Nos. 5,930,026; 6,445,489; 6,504,524; 6,512,354; 6,531,997; 6,753,999; 6,825,970; 6,900,851; 6,995,550; 7,012,600; 7,023,420; 7,034,783; 7,116,466; 7,119,772; 7,193,625; 7,202,847; 7,259,744; 7,304,787; 7,312,794; 7,327,511; 7,453,445; 7,492,339; 7,528,822; 7,545,358; 7,583,251; 7,602,374; 7,612,760; 7,679,599; 7,688,297; 7,729,039; 7,733,311; 7,733,335; 7,787,169; 7,952,557; 7,956,841; 7,999,787; 8,077,141; and 8,558,783; U.S. Patent Applications Publication Nos. 2003/0102858; 2005/0122284; 2005/0253777; 2006/0139308; 2007/0013683; 2007/0091418; 2007/0103427; 2007/0200874; 2008/0024429; 2008/0024482; 2008/0048969; 2008/0129667; 2008/0136774; 2008/0150888; 2008/0291129; 2009/0174651; 2009/0179923; 2009/0195568; 2009/0256799; 2009/0322721; 2010/0045592; 2010/0220121; 2010/0220122; 2010/0265561; 2011/0285754; 2013/0194250 and 2014/0292830; PCT Published Application No. WO 2015/017624; and U.S. patent application Ser. No. 15/014,236 filed Feb. 3, 2016.

The aforementioned patents and applications may hereinafter for convenience collectively be referred to as the "MEDEOD" (MEthods for Driving Electro-Optic Displays) applications. The entire contents of these patents and copending applications, and of all other U.S. patents and published and copending applications mentioned below, are herein incorporated by reference.

BACKGROUND

Aspects of the present disclosure relate to electro-optic displays that display in dark mode, especially bistable electro-optic displays, and to methods and apparatus for dark mode displaying. More specifically, this invention relates to driving methods in dark mode, that is, when displaying white text on a black background, which may allow for reduced ghosting, edge artifacts and flashy updates. Additionally, aspects of this invention relate to applying these driving methods in light mode, that is, when displaying black text on a white or light background, which may allow for reduced ghosting, edge artifacts and flashy updates.

SUMMARY

This invention provides methods of driving an electro-optic display having a plurality of pixels to display white text on a black background ("dark mode") while reducing edge artifacts, ghosting and flashy updates. More specifically, the driving methods allow for reduced "ghosting" and edge artifacts, and reduced flashing in such displays particularly when displaying white text on a black background, and when displaying black text on a white or light background ("light mode"). The present invention reduces the accumulation of edge artifacts by applying a special waveform transition to edge regions according to an algorithm along with methods to manage the DC imbalance introduced by the special transition. In some aspects, this invention is directed towards clearing the white edge that may appear in between adjacent pixels when one pixel is transitioning from a non-black tone to a black state and the other pixel is transitioning from black to black using a null transition (i.e, no voltage is applied to the pixel during this transition) when displaying in dark mode. In such a scenario, edge artifact clearing may be achieved by identifying such adjacent pixel transition pairs and by marking the black to black pixel to receive a special transition called an inverted top-off pulse ("iTop Pulse"). As the iTop Pulse is DC imbalanced, a remnant voltage discharge may be applied, after an update that applied the special transition is complete, to remove the accumulated charge. Further, when displaying in light mode, these special waveforms may be applied inversely (opposite polarity) to reduce ghosting, edge artifacts and flashiness.

Further, the present invention is directed towards clearing the white edge that may appear in between adjacent pixels when one pixel is transitioning from a black to a non-black tone and the other pixel is transitioning from black to black using a null transition or zero transition (i.e, no voltage or zero voltage is applied to the pixel during this transition), when displaying in dark mode. In such a scenario, the black to black pixel is identified to receive a special transition called an inverted Full Pulse transition ("iFull Pulse"). Further, when displaying in light mode, the present invention is directed towards clearing the black edge that may appear between adjacent pixels when one pixel is transitioning from white to non-white and the other is a null transition from white to white by applying the special iFull Pulse transition with the opposite polarity.

BRIEF DESCRIPTION OF DRAWINGS

Various aspects and embodiments of the application will be described with reference to the following figures. It should be appreciated that the figures are not necessarily drawn to scale. Items appearing in multiple figures are indicated by the same reference number in all the figures in which they appear.

FIG. 12 shows an electro-optic display displaying an image in a combination of dark mode and light mode.

DETAILED DESCRIPTION

Figure 1A:
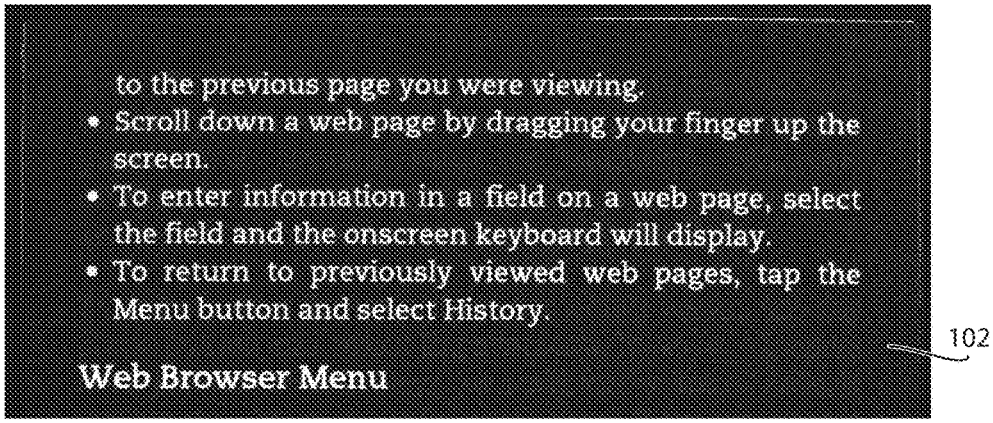
FIG. 1A shows an electro-optic display in a dark mode where edge artifact accumulation is minimal.

The present invention relates to methods for driving electro-optic displays in dark mode, especially bistable electro-optic displays, and to apparatus for use in such methods. More specifically, this invention relates to driving methods which may allow for reduced "ghosting" and edge artifacts, and reduced flashing in such displays when displaying white text on a black background. This invention is especially, but not exclusively, intended for use with particle-based electrophoretic displays in which one or more types of electrically charged particles are present in a fluid and are moved through the fluid under the influence of an electric field to change the appearance of the display.

The term "electro-optic", as applied to a material or a display, is used herein in its conventional meaning in the imaging art to refer to a material having first and second display states differing in at least one optical property, the material being changed from its first to its second display state by application of an electric field to the material. Although the optical property is typically color perceptible to the human eye, it may be another optical property, such as optical transmission, reflectance, luminescence or, in the case of displays intended for machine reading, pseudo-color in the sense of a change in reflectance of electromagnetic wavelengths outside the visible range.

The term "gray state" is used herein in its conventional meaning in the imaging art to refer to a state intermediate two extreme optical states of a pixel, and does not necessarily imply a black-white transition between these two extreme states. For example, several of the E Ink patents and published applications referred to above describe electrophoretic displays in which the extreme states are white and deep blue, so that an intermediate "gray state" would actually be pale blue. Indeed, as already mentioned, the change in optical state may not be a color change at all. The terms "black" and "white" may be used hereinafter to refer to the two extreme optical states of a display, and should be understood as normally including extreme optical states which are not strictly black and white, for example the aforementioned white and dark blue states. The term "monochrome" may be used hereinafter to denote a drive scheme which only drives pixels to their two extreme optical states with no intervening gray states.

Much of the discussion below will focus on methods for driving one or more pixels of an electro-optic display through a transition from an initial gray level (or "graytone") to a final gray level (which may or may not be different from the initial gray level). The terms "gray state," "gray level" and "graytone" are used interchangeably herein and include the extreme optical states as well as the intermediate gray states. The number of possible gray levels in current systems is typically 2-16 due to limitations such as discreteness of driving pulses imposed by the frame rate of the display drivers and temperature sensitivity. For example, in a black and white display having 16 gray levels, usually, gray level 1 is black and gray level 16 is white; however, the black and white gray level designations may be reversed. Herein, graytone 1 will be used to designate black. Graytone 2 will be a lighter shade of black as the graytones progress towards graytone 16 (i.e., white).

The terms "bistable" and "bistability" are used herein in their conventional meaning in the art to refer to displays comprising display elements having first and second display states differing in at least one optical property, and such that after any given element has been driven, by means of an addressing pulse of finite duration, to assume either its first or second display state, after the addressing pulse has terminated, that state will persist for at least several times, for example at least four times, the minimum duration of the addressing pulse required to change the state of the display element. It is shown in U.S. Pat. No. 7,170,670 that some particle-based electrophoretic displays capable of gray scale are stable not only in their extreme black and white states but also in their intermediate gray states, and the same is true of some other types of electro-optic displays. This type of display is properly called "multi-stable" rather than bistable, although for convenience the term "bistable" may be used herein to cover both bistable and multi-stable displays.

The term "impulse" is used herein in its conventional meaning of the integral of voltage with respect to time. However, some bistable electro-optic media act as charge transducers, and with such media an alternative definition of impulse, namely the integral of current over time (which is equal to the total charge applied) may be used. The appropriate definition of impulse should be used, depending on whether the medium acts as a voltage-time impulse transducer or a charge impulse transducer.

The term "remnant voltage" is used herein to refer to a persistent or decaying electric field that may remain in an electro-optic display after an addressing pulse (a voltage pulse used to change the optical state of the electro-optic medium) is terminated. Such remnant voltages can lead to undesirable effects on the images displayed on electro-optic displays, including, without limitation, so-called "ghosting" phenomena, in which, after the display has been rewritten, traces of the previous image are still visible. The application 2003/0137521 describes how a direct current (DC) imbalanced waveform can result in a remnant voltage being created, this remnant voltage being ascertainable by measuring the open-circuit electrochemical potential of a display pixel.

The term "waveform" will be used to denote the entire voltage against time curve used to effect the transition from one specific initial gray level to a specific final gray level. Typically such a waveform will comprise a plurality of waveform elements; where these elements are essentially rectangular (i.e., where a given element comprises application of a constant voltage for a period of time); the elements may be called "pulses" or "drive pulses". The term "drive scheme" denotes a set of waveforms sufficient to effect all possible transitions between gray levels for a specific display. A display may make use of more than one drive scheme; for example, the aforementioned U.S. Pat. No. 7,012,600 teaches that a drive scheme may need to be modified depending upon parameters such as the temperature of the display or the time for which it has been in operation during its lifetime, and thus a display may be provided with a plurality of different drive schemes to be used at differing temperature etc. A set of drive schemes used in this manner may be referred to as "a set of related drive schemes." It is also possible, as described in several of the aforementioned MEDEOD applications, to use more than one drive scheme simultaneously in different areas of the same display, and a set of drive schemes used in this manner may be referred to as "a set of simultaneous drive schemes."

Several types of electro-optic displays are known. One type of electro-optic display is a rotating bichromal member type as described, for example, in U.S. Pat. Nos. 5,808,783; 5,777,782; 5,760,761; 6,054,071 6,055,091; 6,097,531; 6,128,124; 6,137,467; and 6,147,791 (although this type of display is often referred to as a "rotating bichromal ball" display, the term "rotating bichromal member" is preferred as more accurate since in some of the patents mentioned above the rotating members are not spherical). Such a display uses a large number of small bodies (typically spherical or cylindrical) which have two or more sections with differing optical characteristics, and an internal dipole. These bodies are suspended within liquid-filled vacuoles within a matrix, the vacuoles being filled with liquid so that the bodies are free to rotate. The appearance of the display is changed by applying an electric field thereto, thus rotating the bodies to various positions and varying which of the sections of the bodies is seen through a viewing surface. This type of electro-optic medium is typically bistable.

Another type of electro-optic display uses an electrochromic medium, for example an electrochromic medium in the form of a nanochromic film comprising an electrode formed at least in part from a semi-conducting metal oxide and a plurality of dye molecules capable of reversible color change attached to the electrode; see, for example O'Regan, B., et al., Nature 1991, 353, 737; and Wood, D., Information Display, 18(3), 24 (March 2002). See also Bach, U., et al., Adv. Mater., 2002, 14(11), 845. Nanochromic films of this type are also described, for example, in U.S. Pat. Nos. 6,301,038; 6,870,657; and 6,950,220. This type of medium is also typically bistable.

Another type of electro-optic display is an electro-wetting display developed by Philips and described in Hayes, R. A., et al., "Video-Speed Electronic Paper Based on Electrowetting", Nature, 425, 383-385 (2003). It is shown in U.S. Pat. No. 7,420,549 that such electro-wetting displays can be made bistable.

One type of electro-optic display, which has been the subject of intense research and development for a number of years, is the particle-based electrophoretic display, in which a plurality of charged particles move through a fluid under the influence of an electric field. Electrophoretic displays can have attributes of good brightness and contrast, wide viewing angles, state bistability, and low power consumption when compared with liquid crystal displays. Nevertheless, problems with the long-term image quality of these displays have prevented their widespread usage. For example, particles that make up electrophoretic displays tend to settle, resulting in inadequate service-life for these displays.

As noted above, electrophoretic media require the presence of a fluid. In most prior art electrophoretic media, this fluid is a liquid, but electrophoretic media can be produced using gaseous fluids; see, for example, Kitamura, T., et al., "Electrical toner movement for electronic paper-like display", IDW Japan, 2001, Paper HCS1-1, and Yamaguchi, Y., et al., "Toner display using insulative particles charged triboelectrically", IDW Japan, 2001, Paper AMD4-4). See also U.S. Pat. Nos. 7,321,459 and 7,236,291. Such gas-based electrophoretic media appear to be susceptible to the same types of problems due to particle settling as liquid-based electrophoretic media, when the media are used in an orientation which permits such settling, for example in a sign where the medium is disposed in a vertical plane. Indeed, particle settling appears to be a more serious problem in gas-based electrophoretic media than in liquid-based ones, since the lower viscosity of gaseous suspending fluids as compared with liquid ones allows more rapid settling of the electrophoretic particles.

Numerous patents and applications assigned to or in the names of the Massachusetts Institute of Technology (MIT) and E Ink Corporation describe various technologies used in encapsulated electrophoretic and other electro-optic media. Such encapsulated media comprise numerous small capsules, each of which itself comprises an internal phase containing electrophoretically-mobile particles in a fluid medium, and a capsule wall surrounding the internal phase. Typically, the capsules are themselves held within a polymeric binder to form a coherent layer positioned between two electrodes. The technologies described in the these patents and applications include:

(a) Electrophoretic particles, fluids and fluid additives; see for example U.S. Pat. Nos. 7,002,728; and 7,679,814;

(b) Capsules, binders and encapsulation processes; see for example U.S. Pat. Nos. 6,922,276; and 7,411,719;

(c) Films and sub-assemblies containing electro-optic materials; see for example U.S. Pat. Nos. 6,982,178; and 7,839,564;

(d) Backplanes, adhesive layers and other auxiliary layers and methods used in displays; see for example U.S. Pat. Nos. 7,116,318; and 7,535,624;

(e) Color formation and color adjustment; see for example U.S. Pat. No. 7,075,502; and U.S. Patent Application Publication No. 2007/0109219;

(f) Methods for driving displays; see the aforementioned MEDEOD applications;

(g) Applications of displays; see for example U.S. Pat. No. 7,312,784; and U.S. Patent Application Publication No. 2006/0279527; and (h) Non-electrophoretic displays, as described in U.S. Pat. Nos. 6,241,921; 6,950,220; and 7,420,549; and U.S. Patent Application Publication No. 2009/0046082.

Many of the aforementioned patents and applications recognize that the walls surrounding the discrete microcapsules in an encapsulated electrophoretic medium could be replaced by a continuous phase, thus producing a so-called polymer-dispersed electrophoretic display, in which the electrophoretic medium comprises a plurality of discrete droplets of an electrophoretic fluid and a continuous phase of a polymeric material, and that the discrete droplets of electrophoretic fluid within such a polymer-dispersed electrophoretic display may be regarded as capsules or microcapsules even though no discrete capsule membrane is associated with each individual droplet; see for example, the aforementioned U.S. Pat. No. 6,866,760. Accordingly, for purposes of the present application, such polymer-dispersed electrophoretic media are regarded as sub-species of encapsulated electrophoretic media.

A related type of electrophoretic display is a so-called "microcell electrophoretic display". In a microcell electrophoretic display, the charged particles and the fluid are not encapsulated within microcapsules but instead are retained within a plurality of cavities formed within a carrier medium, typically a polymeric film. See, for example, U.S. Pat. Nos. 6,672,921 and 6,788,449, both assigned to Sipix Imaging, Inc.

Although electrophoretic media are often opaque (since, for example, in many electrophoretic media, the particles substantially block transmission of visible light through the display) and operate in a reflective mode, many electrophoretic displays can be made to operate in a so-called "shutter mode" in which one display state is substantially opaque and one is light-transmissive. See, for example, U.S. Pat. Nos. 5,872,552; 6,130,774; 6,144,361; 6,172,798; 6,271,823; 6,225,971; and 6,184,856. Dielectrophoretic displays, which are similar to electrophoretic displays but rely upon variations in electric field strength, can operate in a similar mode; see U.S. Pat. No. 4,418,346. Other types of electro-optic displays may also be capable of operating in shutter mode. Electro-optic media operating in shutter mode may be useful in multi-layer structures for full color displays; in such structures, at least one layer adjacent the viewing surface of the display operates in shutter mode to expose or conceal a second layer more distant from the viewing surface.

An encapsulated electrophoretic display typically does not suffer from the clustering and settling failure mode of traditional electrophoretic devices and provides further advantages, such as the ability to print or coat the display on a wide variety of flexible and rigid substrates. (Use of the word "printing" is intended to include all forms of printing and coating, including, but without limitation: pre-metered coatings such as patch die coating, slot or extrusion coating, slide or cascade coating, curtain coating; roll coating such as knife over roll coating, forward and reverse roll coating; gravure coating; dip coating; spray coating; meniscus coating; spin coating; brush coating; air knife coating; silk screen printing processes; electrostatic printing processes; thermal printing processes; ink jet printing processes; electrophoretic deposition (See U.S. Pat. No. 7,339,715); and other similar techniques.) Thus, the resulting display can be flexible. Further, because the display medium can be printed (using a variety of methods), the display itself can be made inexpensively.

Other types of electro-optic media may also be used in the displays of the present invention.

The bistable or multi-stable behavior of particle-based electrophoretic displays, and other electro-optic displays displaying similar behavior (such displays may hereinafter for convenience be referred to as "impulse driven displays"), is in marked contrast to that of conventional liquid crystal ("LC") displays. Twisted nematic liquid crystals are not bi- or multi-stable but act as voltage transducers, so that applying a given electric field to a pixel of such a display produces a specific gray level at the pixel, regardless of the gray level previously present at the pixel. Furthermore, LC displays are only driven in one direction (from non-transmissive or "dark" to transmissive or "light"), the reverse transition from a lighter state to a darker one being effected by reducing or eliminating the electric field. Finally, the gray level of a pixel of an LC display is not sensitive to the polarity of the electric field, only to its magnitude, and indeed for technical reasons commercial LC displays usually reverse the polarity of the driving field at frequent intervals. In contrast, bistable electro-optic displays act, to a first approximation, as impulse transducers, so that the final state of a pixel depends not only upon the electric field applied and the time for which this field is applied, but also upon the state of the pixel prior to the application of the electric field.

Whether or not the electro-optic medium used is bistable, to obtain a high-resolution display, individual pixels of a display must be addressable without interference from adjacent pixels. One way to achieve this objective is to provide an array of non-linear elements, such as transistors or diodes, with at least one non-linear element associated with each pixel, to produce an "active matrix" display. An addressing or pixel electrode, which addresses one pixel, is connected to an appropriate voltage source through the associated non-linear element. Typically, when the non-linear element is a transistor, the pixel electrode is connected to the drain of the transistor, and this arrangement will be assumed in the following description, although it is essentially arbitrary and the pixel electrode could be connected to the source of the transistor. Conventionally, in high resolution arrays, the pixels are arranged in a two-dimensional array of rows and columns, such that any specific pixel is uniquely defined by the intersection of one specified row and one specified column. The sources of all the transistors in each column are connected to a single column electrode, while the gates of all the transistors in each row are connected to a single row electrode; again the assignment of sources to rows and gates to columns is conventional but essentially arbitrary, and could be reversed if desired. The row electrodes are connected to a row driver, which essentially ensures that at any given moment only one row is selected, i.e., that there is applied to the selected row electrode a voltage such as to ensure that all the transistors in the selected row are conductive, while there is applied to all other rows a voltage such as to ensure that all the transistors in these non-selected rows remain non-conductive. The column electrodes are connected to column drivers, which place upon the various column electrodes voltages selected to drive the pixels in the selected row to their desired optical states. (The aforementioned voltages are relative to a common front electrode which is conventionally provided on the opposed side of the electro-optic medium from the non-linear array and extends across the whole display.) After a pre-selected interval known as the "line address time" the selected row is deselected, the next row is selected, and the voltages on the column drivers are changed so that the next line of the display is written. This process is repeated so that the entire display is written in a row-by-row manner.

It might at first appear that the ideal method for addressing such an impulse-driven electro-optic display would be so-called "general grayscale image flow" in which a controller arranges each writing of an image so that each pixel transitions directly from its initial gray level to its final gray level. However, inevitably there is some error in writing images on an impulse-driven display. Some such errors encountered in practice include:

(a) Prior State Dependence; With at least some electro-optic media, the impulse required to switch a pixel to a new optical state depends not only on the current and desired optical state, but also on the previous optical states of the pixel.

(b) Dwell Time Dependence; With at least some electro-optic media, the impulse required to switch a pixel to a new optical state depends on the time that the pixel has spent in its various optical states. The precise nature of this dependence is not well understood, but in general, more impulse is required the longer the pixel has been in its current optical state.

(c) Temperature Dependence; The impulse required to switch a pixel to a new optical state depends heavily on temperature.

(d) Humidity Dependence; The impulse required to switch a pixel to a new optical state depends, with at least some types of electro-optic media, on the ambient humidity.

(e) Mechanical Uniformity; The impulse required to switch a pixel to a new optical state may be affected by mechanical variations in the display, for example variations in the thickness of an electro-optic medium or an associated lamination adhesive. Other types of mechanical non-uniformity may arise from inevitable variations between different manufacturing batches of medium, manufacturing tolerances and materials variations.

Voltage Errors; The actual impulse applied to a pixel will inevitably differ slightly from that theoretically applied because of unavoidable slight errors in the voltages delivered by drivers.

General grayscale image flow suffers from an "accumulation of errors" phenomenon. For example, imagine that temperature dependence results in a 0.2 L* (where L* has the usual CIE definition:

$$L^*=116(R/R0)^{1/3}-16,$$

where R is the reflectance and R0 is a standard reflectance value) error in the positive direction on each transition. After fifty transitions, this error will accumulate to 10 L*. Perhaps more realistically, suppose that the average error on each transition, expressed in terms of the difference between the theoretical and the actual reflectance of the display is ±0.2 L*. After 100 successive transitions, the pixels will display an average deviation from their expected state of 2 L*; such deviations are apparent to the average observer on certain types of images.

This accumulation of errors phenomenon applies not only to errors due to temperature, but also to errors of all the types listed above. As described in the aforementioned U.S. Pat. No. 7,012,600, compensating for such errors is possible, but only to a limited degree of precision. For example, temperature errors can be compensated by using a temperature sensor and a lookup table, but the temperature sensor has a limited resolution and may read a temperature slightly different from that of the electro-optic medium. Similarly, prior state dependence can be compensated by storing the prior states and using a multi-dimensional transition matrix, but controller memory limits the number of states that can be recorded and the size of the transition matrix that can be stored, placing a limit on the precision of this type of compensation.

Thus, general grayscale image flow requires very precise control of applied impulse to give good results, and empirically it has been found that, in the present state of the technology of electro-optic displays, general grayscale image flow is infeasible in a commercial display.

The aforementioned US 2013/0194250 describes techniques for reducing flashing and edge ghosting. One such technique, denoted a "selective general update" or "SGU" method, involves driving an electro-optic display having a plurality of pixels using a first drive scheme, in which all pixels are driven at each transition, and a second drive scheme, in which pixels undergoing some transitions are not driven. The first drive scheme is applied to a non-zero minor proportion of the pixels during a first update of the display, while the second drive scheme is applied to the remaining pixels during the first update. During a second update following the first update, the first drive scheme is applied to a different non-zero minor proportion of the pixels, while the second drive scheme is applied to the remaining pixels during the second update. Typically, the SGU method is applied to refreshing the white background surrounding text or an image, so that only a minor proportion of the pixels in the white background undergo updating during any one display update, but all pixels of the background are gradually updated so that drifting of the white background to a gray color is avoided without any need for a flashy update. It will readily be apparent to those skilled in the technology of electro-optic displays that application of the SGU method requires a special waveform (hereinafter referred to as an "F" waveform or "F-Transition") for the individual pixels which are to undergo updating on each transition.

The aforementioned US 2013/0194250 also describes a "balanced pulse pair white/white transition drive scheme" or "BPPWWTDS", which involves the application of one or more balanced pulse pairs (a balanced pulse pair or "BPP" being a pair of drive pulses of opposing polarities such that the net impulse of the balanced pulse pair is substantially zero) during white-to-white transitions in pixels which can be identified as likely to give rise to edge artifacts, and are in a spatio-temporal configuration such that the balanced pulse pair(s) will be efficacious in erasing or reducing the edge artifact. Desirably, the pixels to which the BPP is applied are selected such that the BPP is masked by other update activity. Note that application of one or more BPP's does not affect the desirable DC balance of a drive scheme since each BPP inherently has zero net impulse and thus does not alter the DC balance of a drive scheme. A second such technique, denoted "white/white top-off pulse drive scheme" or "WWTOPDS", involves applying a "top-off" pulse during white-to-white transitions in pixels which can be identified as likely to give rise to edge artifacts, and are in a spatio-temporal configuration such that the top-off pulse will be efficacious in erasing or reducing the edge artifact. Application of the BPPWWTDS or WWTOPDS again requires a special waveform (hereinafter referred to as a "T" waveform or "T-Transition") for the individual pixels which are to undergo updating on each transition. The T and F waveforms are normally only applied to pixels undergoing white-to-white transitions. In a global limited drive scheme, the white-to-white waveform is empty (i.e., consists of a series of zero voltage pulses) whereas all other waveforms are not empty. Accordingly, when applicable the non-empty T and F waveforms replace the empty white-to-white waveforms in a global limited drive scheme.

Under some circumstances, it may be desirable for a single display to make use of multiple drive schemes. For example, a display capable of more than two gray levels may make use of a gray scale drive scheme ("GSDS") which can effect transitions between all possible gray levels, and a monochrome drive scheme ("MDS") which effects transitions only between two gray levels, the MDS providing quicker rewriting of the display than the GSDS. The MDS is used when all the pixels which are being changed during a rewriting of the display are effecting transitions only between the two gray levels used by the MDS. For example, the aforementioned U.S. Pat. No. 7,119,772 describes a display in the form of an electronic book or similar device capable of displaying gray scale images and also capable of displaying a monochrome dialogue box which permits a user to enter text relating to the displayed images. When the user is entering text, a rapid MDS is used for quick updating of the dialogue box, thus providing the user with rapid confirmation of the text being entered. On the other hand, when the entire gray scale image shown on the display is being changed, a slower GSDS is used.

Alternatively, a display may make use of a GSDS simultaneously with a "direct update" drive scheme ("DUDS"). The DUDS may have two or more than two gray levels, typically fewer than the GSDS, but the most important characteristic of a DUDS is that transitions are handled by a simple unidirectional drive from the initial gray level to the final gray level, as opposed to the "indirect" transitions often used in a GSDS, where in at least some transitions the pixel is driven from an initial gray level to one extreme optical state, then in the reverse direction to a final gray level; in some cases, the transition may be effected by driving from the initial gray level to one extreme optical state, thence to the opposed extreme optical state, and only then to the final extreme optical state—see, for example, the drive scheme illustrated in FIGS. 11A and 11B of the aforementioned U.S. Pat. No. 7,012,600. Thus, present electrophoretic displays may have an update time in grayscale mode of about two to three times the length of a saturation pulse (where "the length of a saturation pulse" is defined as the time period, at a specific voltage, that suffices to drive a pixel of a display from one extreme optical state to the other), or approximately 700-900 milliseconds, whereas a DUDS has a maximum update time equal to the length of the saturation pulse, or about 200-300 milliseconds.

Variation in drive schemes is, however, not confined to differences in the number of gray levels used. For example, drive schemes may be divided into global drive schemes, where a drive voltage is applied to every pixel in the region to which the global update drive scheme (more accurately referred to as a "global complete" or "GC" drive scheme) is being applied (which may be the whole display or some defined portion thereof) and partial update drive schemes, where a drive voltage is applied only to pixels that are undergoing a non-zero transition (i.e., a transition in which the initial and final gray levels differ from each other), but no drive voltage or zero voltage is applied during zero transitions or null transitions (in which the initial and final gray levels are the same). As used herein, the terms "zero transition" and "null transition" are used interchangeably. An intermediate form of drive scheme (designated a "global limited" or "GL" drive scheme) is similar to a GC drive scheme except that no drive voltage is applied to a pixel which is undergoing a zero, white-to-white transition. In, for example, a display used as an electronic book reader, displaying black text on a white background, there are numerous white pixels, especially in the margins and between lines of text which remain unchanged from one page of text to the next; hence, not rewriting these white pixels substantially reduces the apparent "flashiness" of the display rewriting.

However, certain problems remain in this type of GL drive scheme. Firstly, as discussed in detail in some of the aforementioned MEDEOD applications, bistable electro-optic media are typically not completely bistable, and pixels placed in one extreme optical state gradually drift, over a period of minutes to hours, towards an intermediate gray level. In particular, pixels driven white slowly drift towards a light gray color. Hence, if in a GL drive scheme a white pixel is allowed to remain undriven through a number of page turns, during which other white pixels (for example, those forming parts of the text characters) are driven, the freshly updated white pixels will be slightly lighter than the undriven white pixels, and eventually the difference will become apparent even to an untrained user.

Secondly, when an undriven pixel lies adjacent a pixel which is being updated, a phenomenon known as "blooming" occurs, in which the driving of the driven pixel causes a change in optical state over an area slightly larger than that of the driven pixel, and this area intrudes into the area of adjacent pixels. Such blooming manifests itself as edge effects along the edges where the undriven pixels lie adjacent driven pixels. Similar edge effects occur when using regional updates (where only a particular region of the display is updated, for example to show an image), except that with regional updates the edge effects occur at the boundary of the region being updated. Over time, such edge effects become visually distracting and must be cleared. Hitherto, such edge effects (and the effects of color drift in undriven white pixels) have typically been removed by using a single GC update at intervals. Unfortunately, use of such an occasional GC update reintroduces the problem of a "flashy" update, and indeed the flashiness of the update may be heightened by the fact that the flashy update only occurs at long intervals.

The present invention relates to reducing or eliminating the problems discussed above while still avoiding so far as possible flashy updates. However, there is an additional complication in attempting to solve the aforementioned problems, namely the need for overall DC balance. As discussed in many of the aforementioned MEDEOD applications, the electro-optic properties and the working lifetime of displays may be adversely affected if the drive schemes used are not substantially DC balanced (i.e., if the algebraic sum of the impulses applied to a pixel during any series of transitions beginning and ending at the same gray level is not close to zero). See especially the aforementioned U.S. Pat. No. 7,453,445, which discusses the problems of DC balancing in so-called "heterogeneous loops" involving transitions carried out using more than one drive scheme. A DC balanced drive scheme ensures that the total net impulse bias at any given time is bounded (for a finite number of gray states). In a DC balanced drive scheme, each optical state of the display is assigned an impulse potential (IP) and the individual transitions between optical states are defined such that the net impulse of the transition is equal to the difference in impulse potential between the initial and final states of the transition. In a DC balanced drive scheme, any round trip net impulse is required to be substantially zero.

Figure 1B:
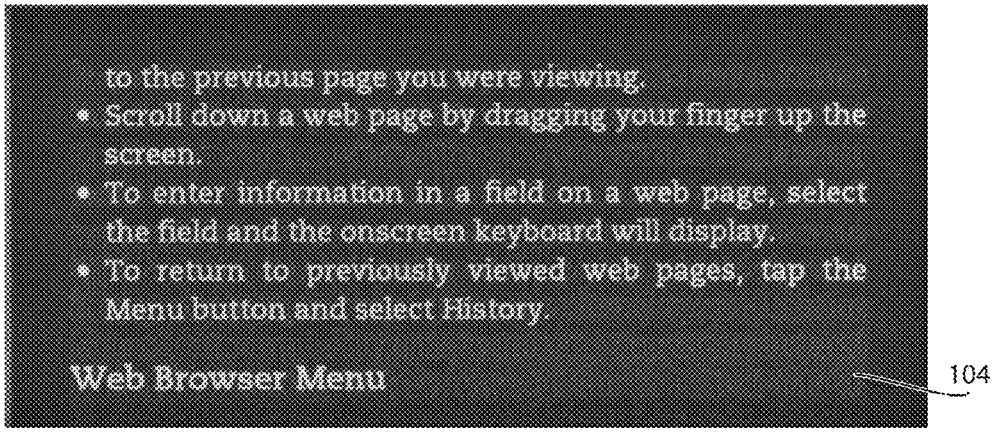
FIG. 1B shows an electro-optic display in a dark mode where edge artifacts accumulate.

In one aspect, this invention provides methods of driving an electro-optic display having a plurality of pixels to display white text on a black background ("dark mode" also referred to herein as "black mode") while reducing edge artifacts, ghosting and flashy updates. In addition, the white text may include pixels having intermediate gray levels, if the text is anti-aliased. Displaying black text on a light or white background is referred to herein as "light mode" or "white mode". FIG. 1A shows an electro-optic display in dark mode where accumulation of edge artifacts 102 is minimized. Typically, when displaying white text on a black background, white edges or edge artifacts may accumulate after multiple updates (as with dark edges in the light mode). This edge accumulation is particularly visible when the background pixels (i.e., pixels in the margins and in the leading between lines of text) do not flash during updates (i.e., the background pixels, which remain in the black extreme optical state through repeated updates, undergo repeated black-to-black zero transitions, during which no drive voltages are applied to the pixels, and they do not flash). FIG. 1B shows an electro-optic display in a dark mode where edge artifacts accumulate 104 when background dark pixels experience zero transitions. A dark mode where no drive voltages are applied during black-to-black transitions may be referred to as a "dark GL mode"; this is essentially the inverse of a light GL mode where no drive voltages are applied to the background pixels undergoing white-to-white zero transitions. The dark GL mode may be implemented by simply defining a zero transition for black-to-black pixels, but also, may be implemented by some other means such as a partial update by the controller.

The purpose of the present invention is to reduce the accumulation of edge artifacts in a dark GL mode by applying a special waveform transition according to an algorithm along with methods to manage the DC imbalance introduced by the special transition. This invention is directed towards clearing the white edge that may appear in between adjacent pixels when one pixel is transitioning from a non-black tone to a black state and the other pixel is transitioning from black to black. For a dark GL mode, the black to black transition is null (i.e, no voltage is applied to the pixel during this transition). In such a scenario, edge artifact clearing may be achieved by identifying such adjacent pixel transition pairs and by marking the black to black pixel to receive a special transition called an inverted top-off pulse ("iTop Pulse").

Figure 2:
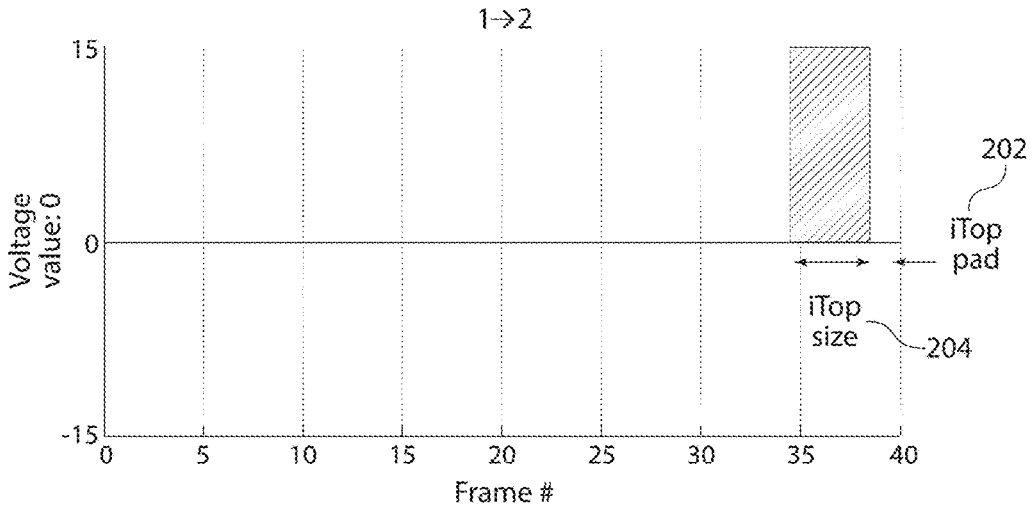
FIG. 2 is a graphical schematic of an inverted top-off pulse, according to some embodiments.

FIG. 2 is a graphical schematic of an inverted top-off pulse. The iTop Pulse may be defined by two tunable parameters—the size (impulse) of the pulse ("iTop size"—i.e., the integral of the applied voltage with respect to time) and the "padding" i.e., the period between the end of the iTop Pulse and end of the waveform ("iTop pad"). These parameters are tunable and may be determined by the type of display and its use, the preferred ranges in number of frames are: size between 1 and 35, and pad between 0 and 50. As stated above these ranges may be larger if display performance so requires.

Figure 3:
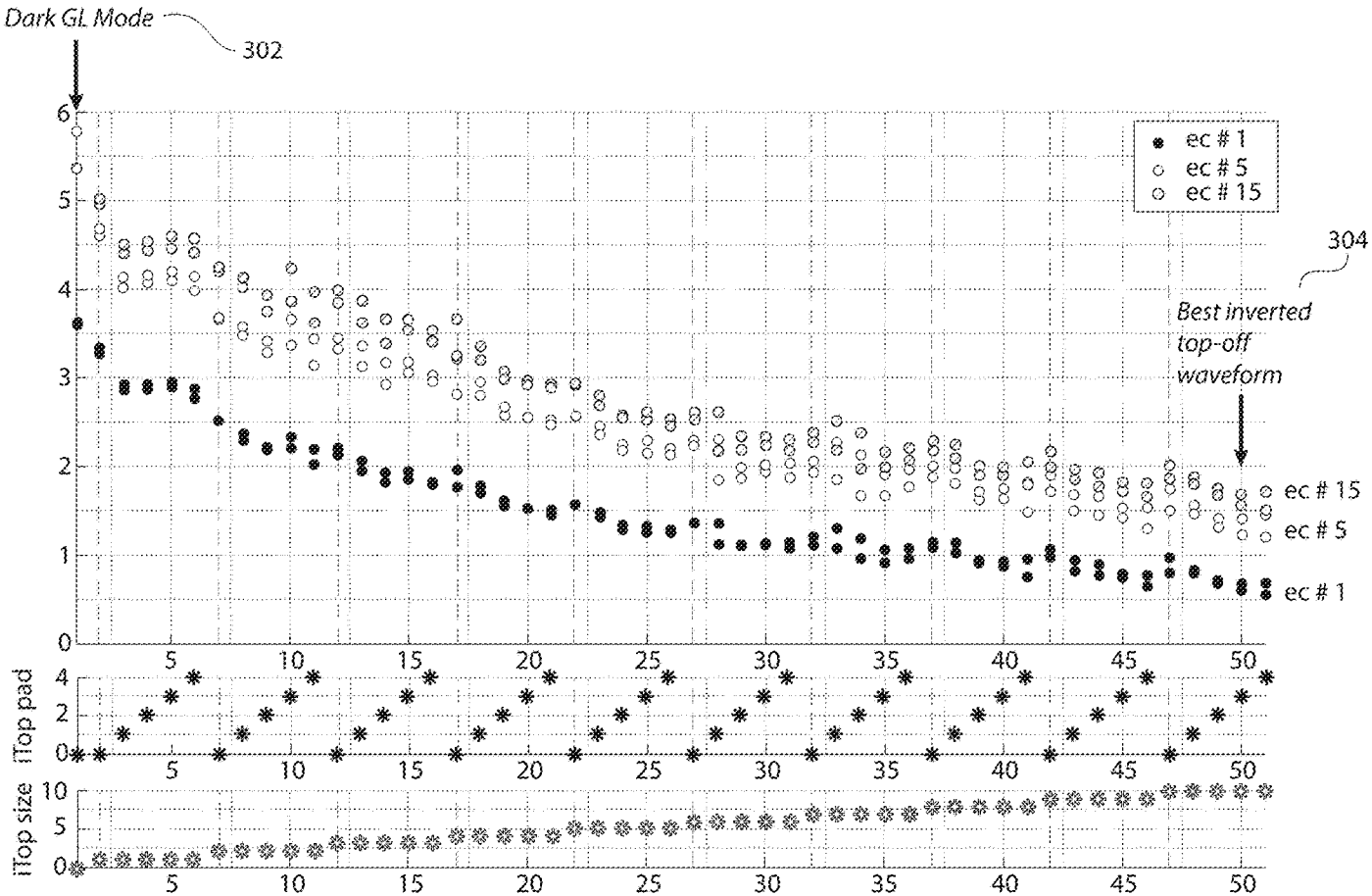
FIG. 3 is a graphical schematic of measured edge strength for a range of iTop tuning parameters, according to some embodiments.

FIG. 3 is a graphical schematic of measured edge component strength in L* for three different active update plus iTop Pulse sequences over a range of iTop size and iTop pad parameters for an embodiment of the present invention. The data labels ec #1, ec #5 and ec #15 indicate the number of times an active update and iTop Pulse are run before quantifying the edge component value in L*. For ec #1, one update and one iTop Pulse are run, then, the L* value is measured. For ec #5, five updates and five iTop Pulses are run, then the L* value is measured, etc. Data point 302 is for the nominal dark GL system where the iTop size and iTop pad are both zero. For this study, the lowest data point for ec #5 304 was selected to be the best iTop waveform, which had an iTop size of 10 and an iTop pad of 3.

Figure 4:
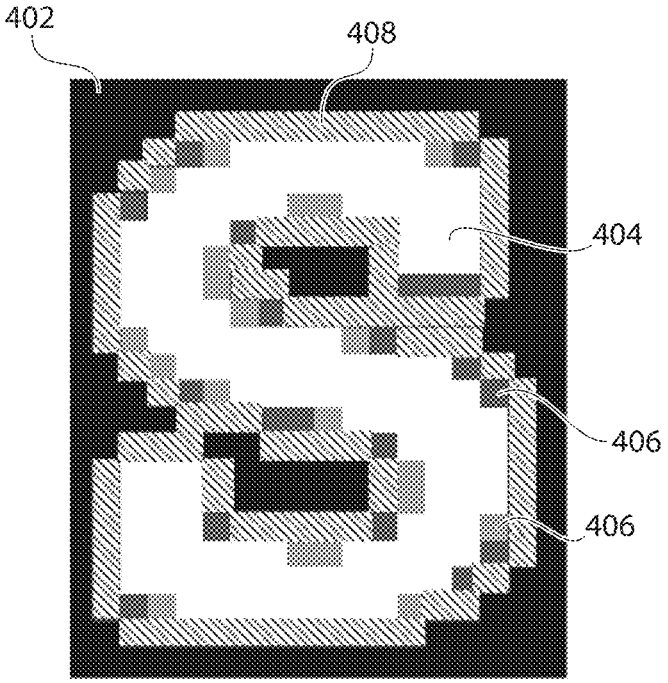
FIG. 4 shows the edge regions on text in a dark mode as areas to apply the inverted top-off pulse, according to some embodiments.

FIG. 4 is an illustrative schematic of an embodiment of the present invention that identifies the edge regions 408 to apply the inverted top-off pulse of white text 404 displayed on a black background 402. In FIG. 4, the text is anti-aliased, so there are graytones 406. The iTop Pulse may be applied to pixels in the edge region 408 as illustrated. Four different versions of the algorithm may be used to identify the number of pixels in the edge region where the iTop Pulse is applied. It may be desirable to minimize the overall number of pixels to which the iTop Pulse is applied, in order to limit DC imbalance and/or prevent excess pixel darkening.

The edge region waveform algorithms use the following data to determine whether a pixel at a location (i,j) is within the edge region or not: the location of a pixel (i,j); the current graytone of pixel (i,j); the next graytone of pixel (i,j); the current and/or next graytones of the cardinal neighbors of pixel (i,j), which denotes the north, south east and west neighbors of pixel (i,j); and the next graytones of the diagonal neighbors of pixel (i,j).

Figure 5A:
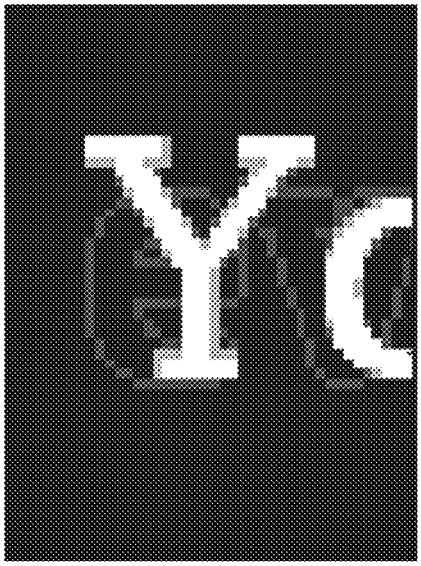
FIG. 5A is an illustrative schematic showing the edge region defined according to the edge region algorithm, Version 1.

FIG. 5A is an illustrative schematic of the first version of the edge region waveform algorithm. In Version 1, edge regions are assigned for all pixels(i,j), in any order, according to the following rules: a) if the pixel graytone transition is not black-to-black, apply the standard waveform, i.e., apply the waveform for the relevant transition for whatever drive scheme is being used; b) if the pixel transition is black-to-black and at least one cardinal neighbor has a current graytone that is not black, apply the iTop waveform; or c) otherwise, apply the black-to-black (GL) null waveform.

In Version 2, edge regions are assigned for all pixels(i,j), in any order, according to the following rules: a) if the pixel graytone transition is not black-to-black, apply the standard waveform; b) if the pixel transition is black-to-black and at least one cardinal neighbor has a current graytone that is not black and a next graytone of black, apply the iTop waveform; or c) otherwise, use the black-to-black (GL) null waveform.

Figure 5B:
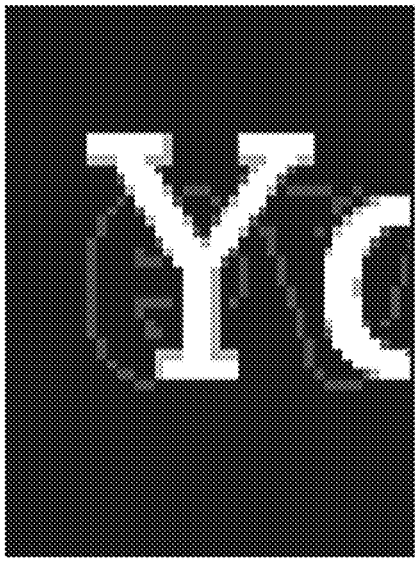
FIG. 5B is an illustrative schematic showing the edge region defined according to the edge region algorithm, Version 3.

FIG. 5B is an illustrative schematic of the third version of the edge region waveform algorithm. In Version 3, edge regions are assigned for all pixels(i,j), in any order, according to the following rules: a) if the pixel graytone transition is not black-to-black, apply the standard waveform; b) if the pixel transition is black-to-black and all four cardinal neighbors have a next graytone of black and at least one cardinal neighbor has a current graytone not black, apply the iTop waveform; or c) otherwise, use the black-to-black (GL) null waveform.

Figure 5C:
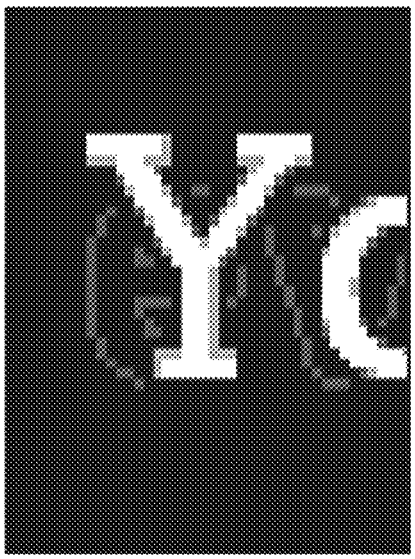
FIG. 5C is an illustrative schematic showing the edge region defined according to the edge region algorithm, Version 4.

FIG. 5C is an illustrative schematic of the fourth version of the edge region waveform algorithm. In Version 4, edge regions are assigned for all pixels(i,j), in any order, according to the following rules: a) if the pixel graytone transition is not black-to-black, apply the standard waveform; b) if the pixel transition is black-to-black and all four cardinal and diagonal neighbors have a next graytone of black and at least one cardinal neighbor has a current graytone that is not black, apply the iTop waveform; or c) otherwise, use the black-to-black (GL) null waveform.

This particular family of algorithms, Versions 1-4, represent a sequential decrease in the overall usage of the iTop Pulse. In some embodiments, decreasing the usage of the iTop Pulse is desired. For example, in situations where pixel neighbors do not transition to black, but rather, transition to white or gray tones, these neighbor transitions are much stronger, and may nullify the iTop transition. Furthermore, if some neighbors end in white or light gray tones, the white edge in the pixel may be less noticeable. As a result, Versions 2 through 4 do not apply the iTop Pulse for various cases when some neighbors do not end in black. These examples illustrate a spectrum of algorithms for which increased complexity leads to a reduction of the application of the iTop transition. Clearly many other algorithms are possible where the iTop is applied in specific situations. These represent tradeoffs in algorithmic complexity, effectiveness, DC-imbalance, pixel darkening, and transition appearance. In some embodiments, algorithms may use per-pixel flags or counters which record edge-inducing events, such as an adjacent white-to-black transition, which then may be used to trigger the iTop Pulse when it is most necessary and efficacious to do so.

The use of a DC imbalance inverted top-off pulse may increase the risk of polarizing the module, and may lead to accelerated module fatigue (global and localized fatigue) and undesirable electrochemistry on the ink system. To mitigate these risks further, a post drive remnant discharging algorithm may be run after an iTop Pulse, as described in aforementioned copending U.S. patent application Ser. No. 15/014,236. In an active matrix display, remnant voltage may be discharged by simultaneously turning on all the transistors associated with the pixel electrodes and connecting the source lines of the active matrix display and its front electrode to the same voltage, typically ground. By having the electrodes on both sides of the electro-optic layer grounded, it is now possible to discharge charges that accumulate in the electro-optic layer as a result of due to DC imbalanced driving.

A remnant voltage of a pixel of an electro-optic display may be discharged by activating the pixel's transistor and setting the voltages of the front and rear electrodes of the pixel to approximately a same value. The pixel may discharge the remnant voltage for a specified period of time, and/or until the amount of remnant voltage remaining in the pixel is less than a threshold amount. In some embodiments, the remnant voltages of two or more pixels in two or more rows of an active matrix of pixels of an electro-optic display may be simultaneously discharged, as opposed to simultaneously discharging only the remnant voltages of two or more pixels in the same row. That is, two or more pixels in different rows of the active matrix may simultaneously be in a same state, characterized by (1) the transistor of each of the two or more pixels being active, and (2) the voltages applied to the front and rear electrodes of each of the two or more pixels being approximately equal. When the two or more pixels are in this same state at the same time, the pixels may simultaneously discharge their remnant voltages. The period during which a pixel is in this state may be referred to as a "remnant voltage discharge period." In some embodiments, the remnant voltages of all pixels in two or more rows (e.g., all pixels in all rows) of an active matrix of pixels may be simultaneously discharged, as opposed to simultaneously discharging only the remnant voltages of two or more pixels in the same row.

In some embodiments, discharging the remnant voltages of all pixels in an active matrix display module at the same time may be achieved by "turning-off" the scanning mode of the active matrix and "turning on" the non-scanning mode. Active-matrix displays typically have circuitry to control voltages of gate lines and circuitry to control source lines that scan through the gate lines and source lines to display an image. These two circuits are commonly contained within "select or gate driver" and "source driver" integrated circuits, respectively. Select and source drivers may be separate chips mounted on a display module, may be integrated into single chips holding circuitry for driving both gate and source lines, and even may be integrated with the display controller.

A preferred embodiment for dissipating remnant voltage brings all pixel transistors into conduction for an extended time. For example, all pixel transistors may be brought into conduction by bringing gate line voltage relative to the source line voltages to values that bring pixel transistors to a state where they are relatively conductive compared to the non-conductive state used to isolate pixels from source lines as part of normal active-matrix drive. For n-type thin film pixel transistors, this may be achieved by bringing gate lines to values substantially higher than source line voltage values. For p-type thin film pixel transistors, this may be achieved by bringing gate lines to values substantially lower than source line voltage values. In an alternative embodiment, all pixel transistors may be brought into conduction by bringing gate line voltages to zero and source line voltages to a negative (or, for p-type transistors, a positive) voltage.

In some embodiments, a specially designed circuitry may provide for addressing all pixels at the same time. In a standard active-matrix operation, select line control circuitry typically does not bring all gate lines to values that achieve the above-mentioned conduction state for all pixel transistors. A convenient way to achieve this condition is afforded by select line driver chips that have an input control line that allows an external signal to impose a condition where all select line outputs receive a voltage supplied to the select driver chosen to bring pixel transistors into conduction. By applying the appropriate voltage value to this special input control line, all transistors may be brought into conduction. By way of example, for displays that have n-type pixel transistors, some select drivers have a "Xon" control line input. By choosing a voltage value to input to the Xon pin input to the select drivers, the "gate high" voltage is routed to all the select lines.

Figure 6A:
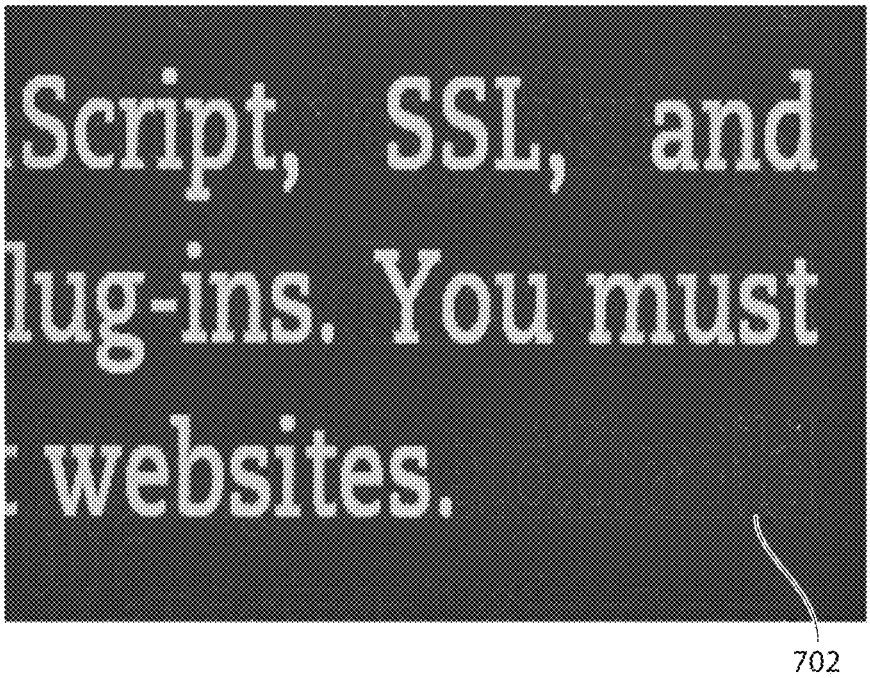
FIG. 6A shows an electro-optic display after applying the dark GL algorithm to a particular update sequence.

FIG. 6A shows the results of applying the dark GL algorithm after six consecutive dark mode text updates ("Text 6 Update Sequence" which updates in the following sequence: White-Black-Black-Black-Text1-Text2-Text3-Text4-Text5-Text6). The accumulation of edge artifacts 702 in the background is apparent.

Figure 6B:
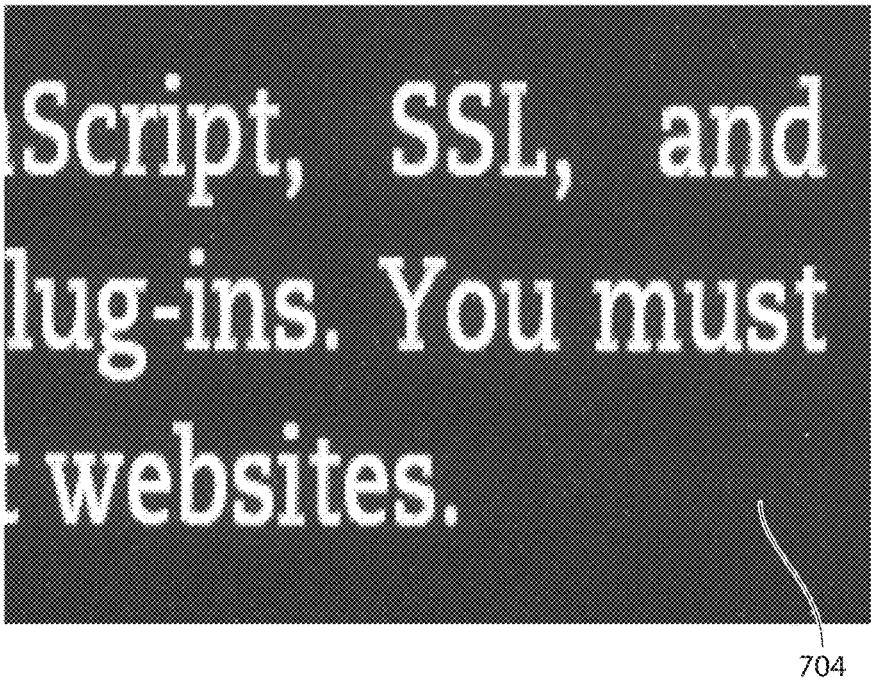
FIG. 6B shows an electro-optic display after applying Version 3 of the edge regions algorithm along with the iTop Pulse and remnant voltage discharge to a particular update sequence.

FIG. 6B shows the results of applying Version 3 of the edge region algorithm along with the iTop Pulse and remnant voltage discharge (uPDD with 500 ms delay time) after the same "Text 6 Update Sequence". The accumulation of edge artifacts 704 in the background is minimized.

Figure 7A:
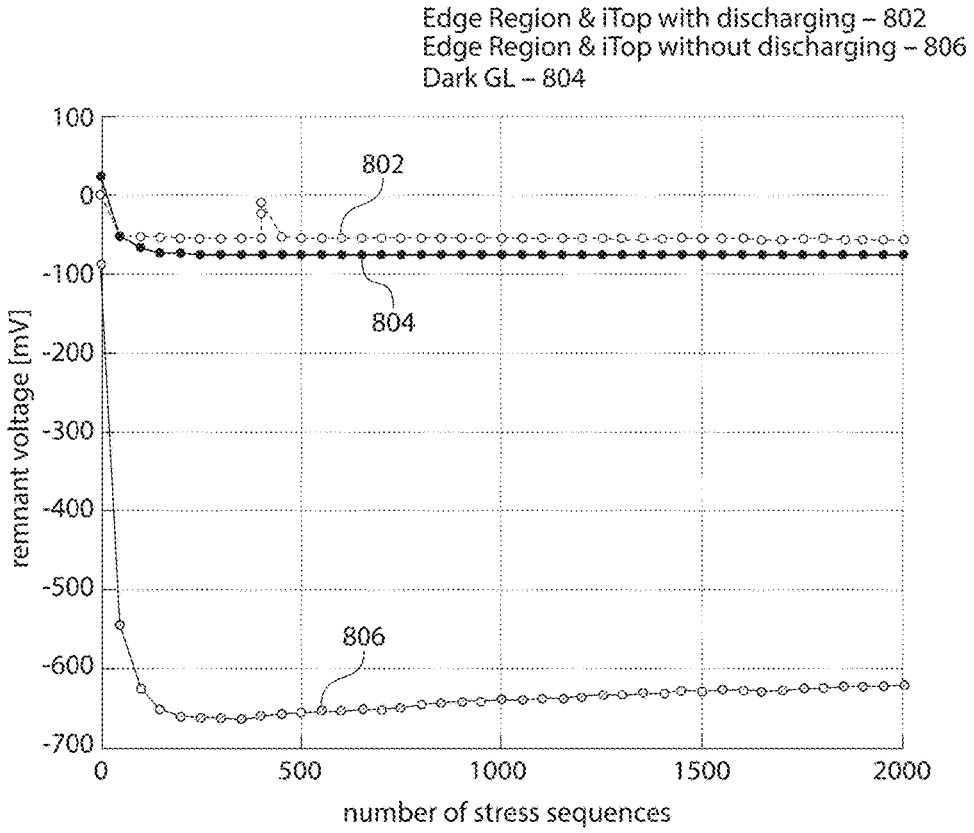
FIG. 7A is graphical representation of remnant voltage values against the number of dark mode sequences for three different dark mode algorithms, according to some embodiments.
Figure 7B:
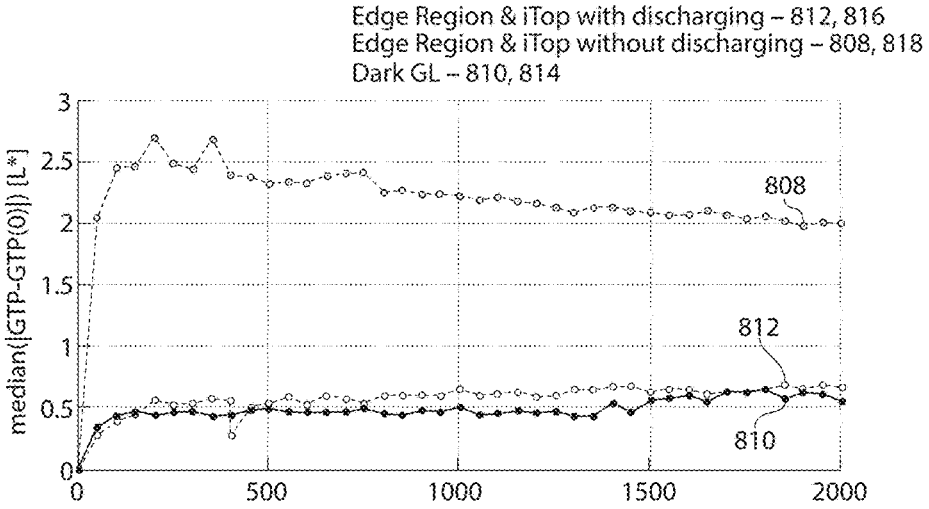
FIG. 7B is graphical representation of corresponding graytone placement shift in L* values against the number of dark mode sequences for three different dark mode algorithms, according to some embodiments.
Figure 7C:
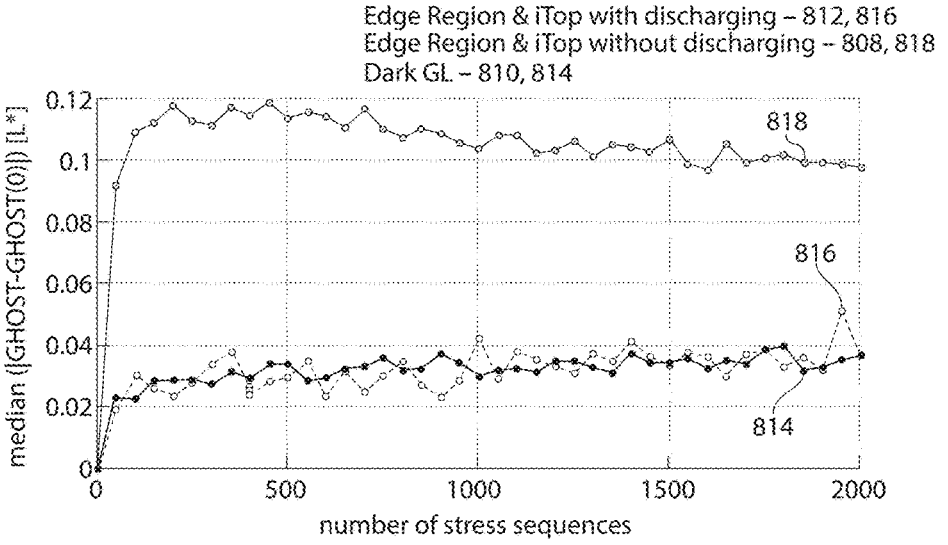
FIG. 7C is graphical representation of ghosting in L* values against the number of dark mode sequences for three different dark mode algorithms, according to some embodiments.

FIG. 7A is a graphical representation that measures remnant voltage values against the number of dark mode sequences for the dark GL algorithm 804, the edge region algorithm plus iTop Pulse only 806, and the edge region algorithm plus iTop Pulse and remnant voltage discharge 802, in a worst case scenario where the dark mode sequences were made up of nine updates of dither pattern. In this experiment, discharging remnant voltage mitigated the risk of excessive module polarization that may be introduced by the iTop Pulse and, in turn, mitigated excessive optical response shifts. FIG. 7B graphs the results for the corresponding gray tone placement shift sequences for the dark GL algorithm 810, the edge region algorithm plus iTop Pulse 808, and the edge region algorithm plus iTop Pulse and remnant voltage discharge 812 under the same worst case scenario. FIG. 7C graphs the median amount of ghosting in L* values against the number of dark mode sequences for the dark GL algorithm 814, the edge region algorithm plus iTop Pulse 818, and edge region algorithm plus iTop Pulse and remnant voltage discharge 816 under the same worst case scenario. Based on this data, the best overall performance resulted from using the edge region algorithm plus iTop Pulse and a remnant voltage discharge.

In a practical implementation, it may not be possible to have several seconds for remnant voltage discharge to run after every update; remnant voltage discharge may be interrupted if a new update on the module is initiated before the remnant voltage discharge is completed and thus the full benefits of the discharge may not be obtained. If this happens infrequently, as may be expected in an electronic document reader (where the user will typically pause for at least ten seconds to read the new page presented after each update), it will have little effect on display performance since later remnant voltage discharges will remove any remnant voltage remaining after the interrupted discharge. If the remnant voltage discharge is interrupted regularly during numerous consecutive updates, for example, during fast page flipping, eventually sufficient remnant voltage may build up on the display to cause permanent damage. To prevent such damaging charge accumulation, a timer may be incorporated into the controller to recognize if the remnant voltage discharge process has been interrupted by a supervening transition. If the number of interrupted remnant voltage discharges within a predetermined period exceeds an empirically-determined threshold, the use of the iTop waveform until the discharging has occurred. This may result in a temporary increase in edge artifacts, but they can be cleared by a GC update once the fast page turning has finished.

Figure 8A:
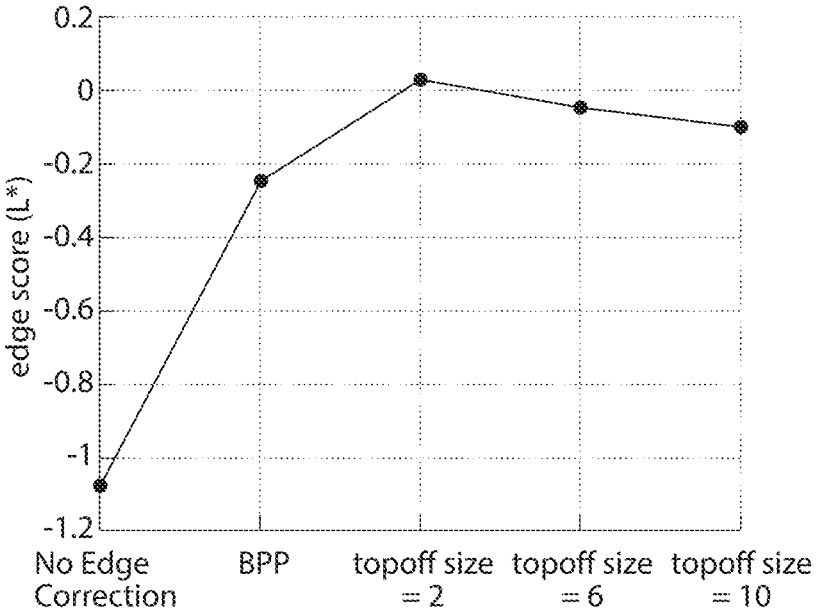
FIG. 8A is a graphical representations showing edge scores in L* for light mode displaying at 25° C. when applying different waveforms.
Figure 8B:
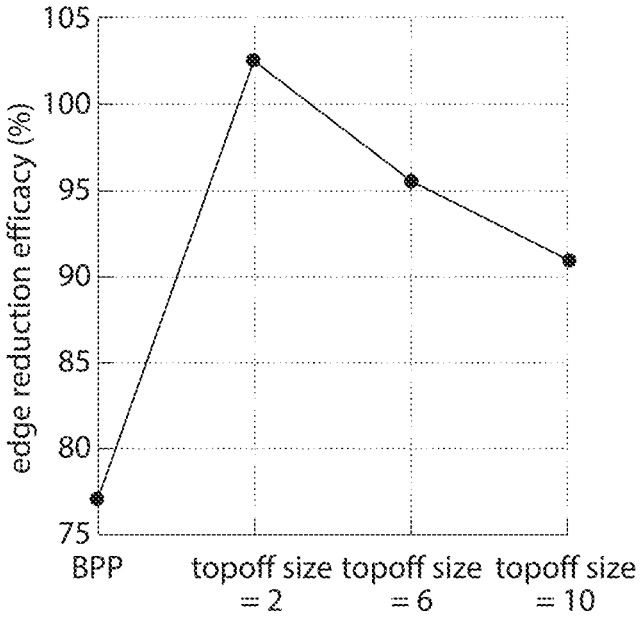
FIG. 8B is a graphical representations showing edge reduction efficacy in percent corresponding to the values in FIG. 8A.

The iTop Pulse used in dark mode displaying may be applied inversely (opposite polarity) to reduce ghosting, edge artifacts and flashiness when displaying in light mode as a "top-off pulse". As described in aforementioned U.S. Patent Publication No. 2013/0194250, a "top-off pulse" applied to a white or near-white pixel drives the pixel to the extreme optical white state (and is the opposite polarity of the iTop Pulse, which drives the pixel to the extreme optical black state). Typically, the top-off pulse is not used due to its DC imbalanced waveform. However, when used in conjunction with the remnant voltage discharging, the effects of the DC imbalanced waveform may be reduced or eliminated and the display performance may be enhanced. Thus, the top-off pulse is less limited in terms of size and application. As is shown in FIGS. 8A and 8B, the top-off size may be up to 10 frames and may be even greater. Further, as described, the top-off pulse may be applied in place of the balanced pulse pair ("BPP"), which is a pair of drive pulses of opposing polarities such that the net impulse of the balanced pulse pair is substantially zero.

FIGS. 8A and 8B are graphical representations showing edge scores and corresponding edge reduction efficacy, respectively, for light mode displaying at 25° C. when no edge correction is applied, when a BPP transition is applied and when top-off pulses having different topoff sizes with a single topoff padding are applied. The edge score is measured in L* values and an edge score of 0 L* is ideal. The edge reduction efficacy is measured in percentage (%) and an edge reduction efficacy of 100% is ideal. As shown, the DC imbalance top-off pulses for edge clearing may improve light mode performance compared to no edge correction and even the BPP transition at 25° C. As the number of frames of topoff (top-off size) is increased from 2 to 10, the edge score and edge reduction efficiency values change which indicates that the waveform may be tunable in order to achieve the best performance especially across different temperatures, as edge erasing efficacy will change as conductivity of the material changes with temperature.

The aforementioned copending US 2013/0194250 and US 2014/0292830 describe several techniques for improving image quality in black-on-white displays, and it may be beneficial to be able to use these techniques in white-on-black displays (i.e., in dark mode), for example, to enable displays retrofitting of displays that already support such these techniques. One way to enable this is to create a special "dark mode" modification of the drive schemes used to implement the aforementioned techniques. The dark mode drive scheme modification would be constructed by inverting the gray scale used, such that the transition from an initial to a final gray level would go from inverted grayscale N to 1 instead of the regular grayscale of 1 to N (where N is the number of gray levels being used in the drive scheme). In other words, in the modified drive scheme, the [A−B] waveform (i.e., the transition from gray level A to gray level B) would be the [(N+1−A)−(N+1−B)] waveform from the unmodified drive scheme. For example, the modified 16-16 waveform would use the actual 1-1 waveform from the unmodified drive scheme, while the modified 16-3 waveform would use the actual 1-14 waveform from the unmodified drive scheme. The modified dark mode drive scheme would require two additional drive schemes in order to transition from "light mode" into and out of "dark mode". These additional "IN" and "OUT" drive schemes would perform the changes required on the display to reset the image in the new dark or light mode. For example, the 16-16 waveform in the IN drive scheme would be the actual 16-1 transition of the dark mode drive scheme in order to change the background from white to black even though the background would be regarded as being in state 16 in both the previous light mode drive scheme and the subsequent dark mode drive scheme. Similarly, the 3-3 waveform of the IN drive scheme would contain the actual 3-to-14 waveform of the dark mode drive scheme. The OUT waveform would simply reverse these changes. By using the modified drive scheme, the image rendering software (whether internal or external to the display controller) would not need to change the rendering of images depending upon whether the display was in light or dark mode, but would simply invoke the dark mode drive scheme to display in the images in the dark or light mode as required.

This invention provides methods of driving an electro-optic display having a plurality of pixels to display white text on a black background ("dark mode") while reducing ghosting, edge artifacts and flashiness. In addition, the white text may include pixels having intermediate gray levels, if the text is anti-aliased. This invention is directed towards clearing the white edge that may appear in between adjacent pixels when a pixel is transitioning and an adjacent pixel is not transitioning. For example, a white edge artifact may appear in between adjacent pixels when one pixel is transitioning from a black to a non-black tone and the other pixel is transitioning from black to black. For a dark GL mode, this black to black transition is null (i.e, no voltage is applied to the pixel during this transition). Edge artifacts may accumulate with each image update and, particularly, when implementing a non-flashy dark mode (i.e. where the background does not flash during page turns as in the dark GL mode). In such scenarios, edge artifact clearing may be achieved by identifying such adjacent pixel transition pairs and by marking the null black to black pixel to receive a special transition called an inverted Full Pulse transition ("iFull Pulse").

Another common scenario where edge artifacts accumulate is when images are dithered to create intermediary gray levels from a black state, such as when one pixel having a null transition (i.e., black to black) is adjacent to a pixel with a black to non-black transition. Typically, a display may have up to 16 gray levels. By dithering, additional intermediary gray levels may be attained. For example, by dithering graytone N and graytone N+1, a gray level in between graytone N and N+1 may be attained. One common dithering scenario that accumulates edge artifacts is dithering in a checkerboard pattern using graytone 1 ("G1") and graytone 2 ("G2") when the prior image is G1 (i.e., black, in this example). The G1 to G2 transition will create significant edge artifacts where the pixel transition from G1 to G1 is a null transition adjacent to a pixel transition from G1 to G2.

Figure 9:
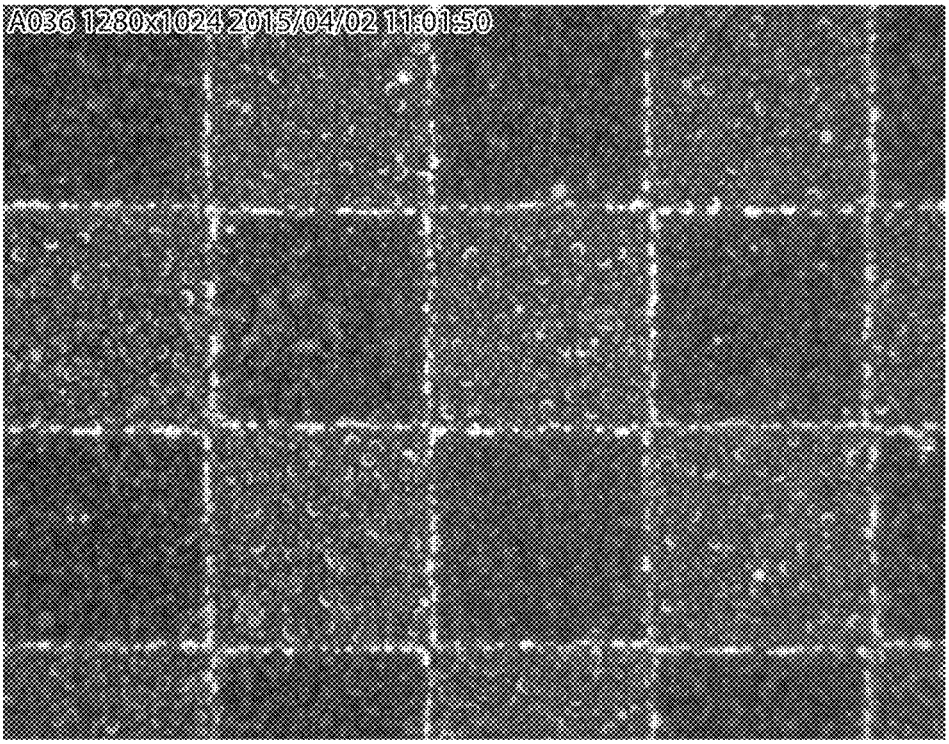
FIG. 9 is a magnified image of an electrophoretic display showing a dithered checkerboard pattern of graytone 1 (black) and graytone 2 where the prior image was graytone 1 (black) with the resulting edge artifacts shown in lighter graytone/white.

FIG. 9 is a magnified image of an electrophoretic display showing such a dithered checkerboard pattern of G1 and G2 where the prior image was G1 with the resulting edge artifacts shown in lighter graytone/white. Each checkerboard square is a 4×4 pixel where each G1 square receives a null transition (G1 to G1) while each G2 square receives a G1 to G2 transition. As these edge artifacts accumulate, the display performance decreases and the overall lightness (i.e., L* value) of the display increases. One way to clear these edge artifacts is to apply an iFull Pulse transition on a selected edge region chosen by a waveform algorithm.

As with the "light mode" (i.e. black text on a white background) SGU transition described in aforementioned US2013/0194250, the iFull Pulse transition for the dark mode can take the form of the standard black to black transition (i.e., an initial drive from black to white, then a drive back to black), which is simply an inverse of a white to white transition in light mode. However, in the dark mode, when a null black to black transition (unchanged) pixel is adjacent to a standard black to black transition pixel, edge artifacts may result and cause lightness error. In the case described in the previous paragraph, the application of the iFull Pulse as a standard black to black transition on a selected edge region may result in new edges. These new edges will appear when the pixel experiencing the iFull Pulse transition is adjacent to a pixel experiencing the null black to black transition. In this disclosure, the iFull Pulse transition will not be a standard black to black transition. The proposed iFull Pulse transition is described below in detail.

Figure 10:
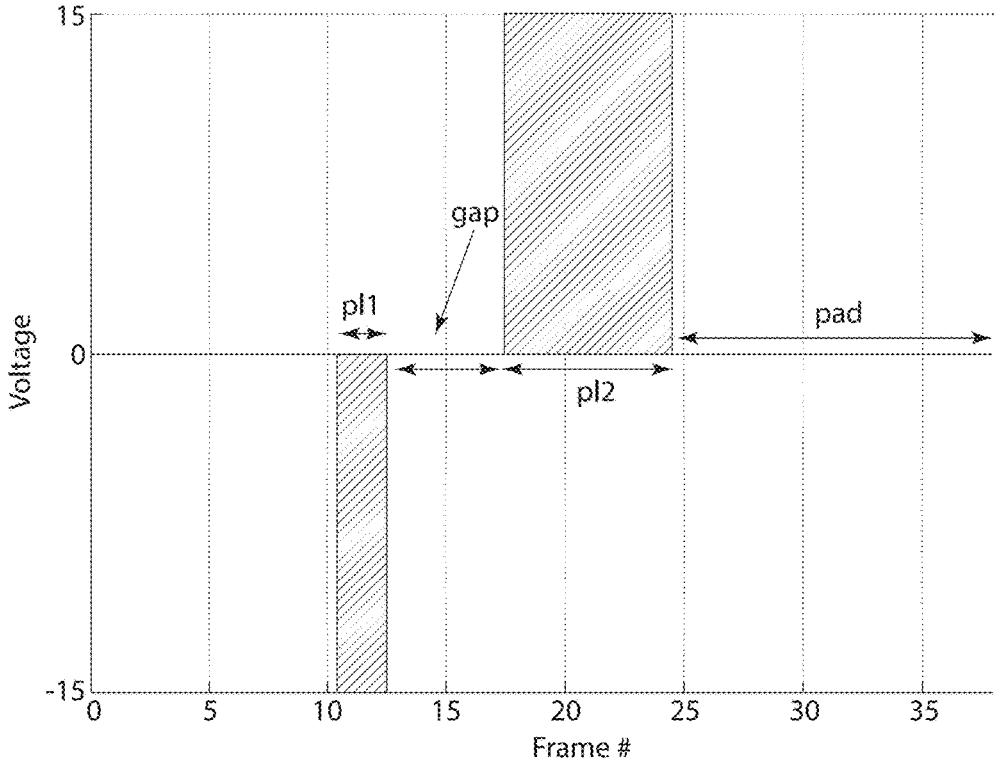
FIG. 10 is a graphical schematic of a iFull Pulse by voltage and frame number, according to some embodiments.

FIG. 10 is a graphical schematic of an iFull Pulse where voltage is on the y-axis and frame number is on the x-axis. Each frame number denotes the time interval of 1 over the frame rate of the active matrix module. The iFull Pulse may be defined by four tunable parameters: 1) the size (impulse) of the iFull Pulse that drives to white ("pl1" parameter); 2) the "gap" parameter, i.e., the period between the end of the "pl1 " and the "pl2" parameter; 3) the size of the iFull Pulse that drives to black ("pl2") and the "padding" parameter—i.e., the period between the end of the pl2 and end of the waveform ("pad"). The pl1 represents the initial drive to white state. The pl2 represents the drive to black state. The iFull Pulse improves lightness error by erasing the edge artifacts that may be created by adjacent pixels not driving from black to black. However, the iFull Pulse may introduce significant DC imbalance. The iFull Pulse parameters are tunable to optimize the performance of the display by reducing edge artifact accumulation with minimum DC imbalance. Although all parameters are tunable and may be determined by the type of display and its use, the preferred ranges in number of frames are: impulse size between 1 and 25, gap between 0 and 25, size between 1 and 35, and pad between 0 and 50. As stated above these ranges may be larger if display performance so requires.

In a preferred embodiment, four edge region waveform algorithms may be applied to determine whether or not to apply the iFull Pulse. The edge region waveform algorithms use the following data to determine whether a pixel at a location (i,j) is likely to create an edge artifact or not: 1) the location of a pixel (i,j); 2) the current graytone of pixel (i,j); 3) the next graytone of pixel (i,j); 4) the current and/or next graytones of the cardinal neighbors of pixel (i,j), where "cardinal" denotes the north, south east and west neighbors of pixel (i,j); and 5) the next graytones of the diagonal neighbors of pixel (i,j).

In the first version of the edge region algorithm ("Version 1"), edge regions are assigned for all pixels(i,j) according to the following rules, in order of priority: a) if the pixel graytone transition is not black-to-black, apply the standard waveform, i.e., apply the waveform for the relevant transition for whatever drive scheme is being used; b) if the pixel transition is black-to-black and at least one cardinal neighbor has a current graytone that is not black, apply the iTop waveform (as described in previously cited U.S. Provisional Application 62/112,060, filed Feb. 4, 2015); c) if the pixel transition is black-to-black and at least SIT cardinal neighbors are not transitioning from black to black, apply the iFull Pulse black to black waveform; or d) otherwise, apply the black-to-black (GL) null waveform.

In the second version of the edge region algorithm ("Version 2"), edge regions are assigned for all pixels(i,j) according to the following rules, in order of priority: a) if the pixel graytone transition is not black-to-black, apply the standard waveform; b) if the pixel transition is black-to-black and at least one cardinal neighbor has a current graytone that is not black and a next graytone of black, apply the iTop waveform; c) if the pixel transition is black-to-black and at least SIT cardinal neighbors are not transitioning from black to black, apply the iFull Pulse black to black waveform; or d) otherwise, use the black-to-black (GL) null waveform.

In the third version of the edge region algorithm ("Version 3"), edge regions are assigned for all pixels(i,j) according to the following rules, in order of priority: a) if the pixel graytone transition is not black-to-black, apply the standard waveform; b) if the pixel transition is black-to-black and all four cardinal neighbors have a next graytone of black and at least one cardinal neighbor has a current graytone not black, apply the iTop waveform; c) if the pixel transition is black-to-black and at least SIT cardinal neighbors are not transitioning from black to black, apply the iFull Pulse black to black waveform; or d) otherwise, use the black-to-black (GL) null waveform.

In the fourth version of the edge region algorithm ("Version 4"), edge regions are assigned for all pixels(i,j) according to the following rules, in order of priority: a) if the pixel graytone transition is not black-to-black, apply the standard waveform; b) if the pixel transition is black-to-black and all four cardinal and diagonal neighbors have a next graytone of black and at least one cardinal neighbor has a current graytone that is not black, apply the iTop waveform; c) if the pixel transition is black-to-black and at least SIT cardinal neighbors are not transitioning from black to black, apply the iFull Pulse black to black waveform; or d) otherwise, use the black-to-black (GL) null waveform.

The SIT value range from 0 to 5 which represents zero to the maximum number of cardinal neighbors plus one. The SIT value balances the impact of the iFull Pulse which decreases edge artifacts but increases exposure to module polarization (i.e., buildup of residual charge due DC imbalance waveform), which may degrade display performance. When the SIT value is zero, the maximum number of black to black pixel transitions will be made by applying the iFull Pulse. This maximally reduces the amount of edge artifacts but increases the risk of excessive module polarization due to the DC imbalance of the iFull Pulse waveform. When the SIT value is 1, 2 or 3, an intermediate number of pixels transitioning from black to black will be converted using the iFull Pulse. These values enable the display to reduce edge artifacts, though less than a SIT value of zero, and reduce the risk of excessive module polarization. When the SIT value is 4, the number of black to black transitions using the iFull Pulse waveform will be minimized. The ability to reduce edge artifacts is diminished but the risk of excessive module polarization is the smallest. When the SIT value is 5, the iFull Pulse waveform is disabled and not applied to reduce edge artifacts. The SIT value may be preset or may be determined by the controller.

The use of a DC imbalance iFull Pulse may increase the risk of polarizing the module, and may lead to accelerated module fatigue (global and localized fatigue) and undesirable electrochemistry on the ink system. To mitigate these risks further, a post drive remnant discharging algorithm may be run after a iFull Pulse, as described in aforementioned copending U.S. patent application Ser. No. 15/014,236 and described above.

In an active matrix display, remnant voltage may be discharged by simultaneously turning on all the transistors associated with the pixel electrodes and connecting the source lines of the active matrix display and its front electrode to the same voltage, typically ground. By having the electrodes on both sides of the electro-optic layer grounded, it is now possible to discharge charges that accumulate in the electro-optic layer as a result of DC imbalanced driving.

Figure 11:
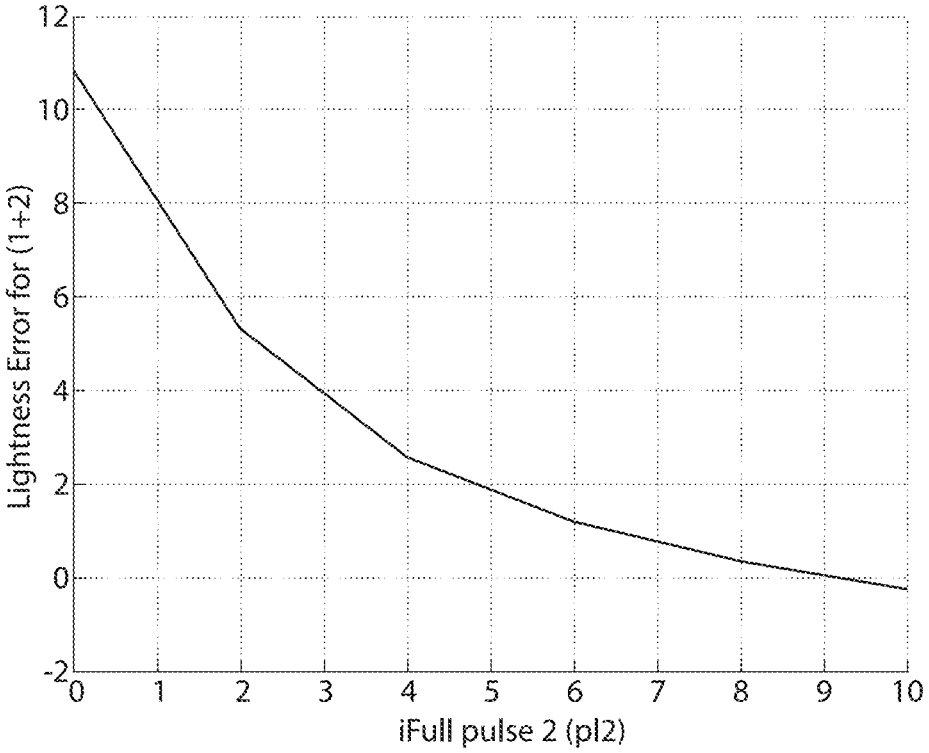
FIG. 11 is a graphical representation that measures lightness error in L* values against the frame size of the applied iFull Pulse for a dithered checkerboard pattern of graytone 1 and graytone 2 where the prior image was graytone 1, according to some embodiments.

FIG. 11 shows, at the macroscopic level, that the accumulation of edge artifacts may result in a significant increase in lightness for the desired dithering pattern. For example, a 1×1 pixel checkerboard dithering pattern of G1 and G2 driven from an initial G1 image may have up to 10L* increase in lightness compared to the desired lightness. This will result in significant ghosting, in particular when the G1 and G2 checkerboard dithering pattern has areas where the prior image is black located to areas where the prior image is white. This is because the lightness of the G1 and G2 dithering pattern where the prior image is white is typically much closer to the desired lightness. By applying the iFull Pulse, the accumulation of edge artifacts is reduced as is the lightness error.

FIG. 11 is a graphical representation that measures lightness error in L* values against the frame size of the applied pl2 size for a G1 and G2 dithering pattern having a 1×1 pixel checkerboard where the prior image was G1. In this experiment, only the pl2 size parameter was changed—the pl1 and gap were set at 0 frames and the pad was set at 1 frame. The lightness error was determined by comparing a measured L* value to the expected L* value, which, in this case, is [(Lightness G1+Lightness G2)/2]. In this experiment, a larger pl2 size mitigated the lightness error. When the pl2 size was 0 frames (i.e., the iFull Pulse was not applied), the lightness error was approximately 11 L*. When the pl2 size was 9 frames, there was almost no lightness error. When the pl2 size was 10 frames, the lightness error was a negative value, which indicates that the display was darker, rather than lighter, than it should have been.

In another experiment where the iFull Pulse was applied and the other parameters were increased, the amount of lightness error was reduced. For a iFull Pulse having a pl1 of 0 frames, a gap of 0 frames, a pl2 size of 5 frames and a pad of 18 frames, the lightness error was 1.5 L* as compared to approximately 2 L* when the first three parameters were the same and the pad was 1 frame (e.g., see FIG. 10). Similarly, in another experiment where the pl1 and pad parameters were increased, the amount of lightness error was reduced. For a iFull Pulse having a pl1 size of 2 frames, a gap of 0 frames, a pl2 size of 7 frames and a pad of 18 frames, the lightness error was 1.1 L*.

As described aforementioned US2013/0194250, the selective general update (SGU) transition is intended for use in an electro-optic display having a plurality of pixels and displaying in light mode. The SGU method makes use of a first drive scheme, in which all pixels are driven at each transition, and a second drive scheme, in which pixels undergoing some transitions are not driven. In the SGU method, the first drive scheme is applied to a non-zero minor proportion of the pixels during a first update of the display, while the second drive scheme is applied to the remaining pixels during the first update. During a second update following the first update, the first drive scheme is applied to a different non-zero minor proportion of the pixels, while the second drive scheme is applied to the remaining pixels during the second update. In a preferred form of the SGU method, the first drive scheme is a GC drive scheme and the second drive scheme is a GL drive scheme.

As described in aforementioned US2013/0194250, the balanced pulse pair white/white transition drive scheme (BPPWWTDS) is intended to reduce or eliminate edge artifacts when displaying in light mode. The BPPWWTDS requires the application of one or more balanced pulse pairs (a balanced pulse pair or "BPP" being a pair of drive pulses of opposing polarities such that the net impulse of the balanced pulse pair is substantially zero) during white-to-white transitions in pixels which can be identified as likely to give rise to edge artifacts, and are in a spatio-temporal configuration such that the balanced pulse pair(s) will be efficacious in erasing or reducing the edge artifact. The BPPWWTDS attempts to reduce the visibility of accumulated errors in a manner which does not have a distracting appearance during the transition and in a manner that has bounded DC imbalance. This is effected by applying one or more balanced pulse pairs to a subset of pixels of the display, the proportion of pixels in the subset being small enough that the application of the balanced pulse pairs is not visually distracting. The visual distraction caused by the application of the BPP's may be reduced by selecting the pixels to which the BPP's are applied adjacent to other pixels undergoing readily visible transitions. For example, in one form of the BPPWWTDS, BPP's are applied to any pixel undergoing a white-to-white transition and which has at least one of its eight neighbors undergoing a (not white)-to-white transition. The (not white)-to-white transition is likely to induce a visible edge between the pixel to which it is applied and the adjacent pixel undergoing the white-to-white transition, and this visible edge can be reduced or eliminated by the application of the BPP's. This scheme for selecting the pixels to which BPP's are to be applied has the advantage of being simple, but other, especially more conservative, pixel selection schemes may be used. A conservative scheme (i.e., one which ensures that only a small proportion of pixels have BPP's applied during any one transition) is desirable because such a scheme has the least impact on the overall appearance of the transition.

As already indicated, the BPP's used in the BPPWWTDS can comprise one or more balanced pulse pairs. Each half of a balanced pulse pair may consist of single or multiple drive pulses, provided only that each of the pair has the same amount. The voltages of the BPP's may vary provided only that the two halves of a BPP must have the same amplitude but opposite sign. Periods of zero voltage may occur between the two halves of a BPP or between successive BPP's. For example, in one experiment, the results of which are described below, the balanced BPP's comprises a series of six pulses, +15V, −15V, +15V, −15V, +15V, −15V, with each pulse lasting 11.8 milliseconds. It has been found empirically that the longer the train of BPP's, the greater the edge erasing which is obtained. When the BPP's are applied to pixels adjacent to pixels undergoing (non-white)-to-white transitions, it has also been found that shifting the BPP's in time relative to the (non-white)-to-white waveform also affects the degree of edge reduction obtained. There is at present no complete theoretical explanation for these findings.

Another aspect of the present invention is to reduce edge artifacts, ghosting and/or flashiness when displaying in a combination of light mode and dark mode. FIG. 12 shows an electro-optic display displaying an image in a combination of dark mode and light mode. The imaging waveform for light mode and dark mode displaying combines special waveform algorithms for clearing edge artifacts and reducing flashiness as well as the normal waveforms used for displaying in light mode and dark mode. These special waveforms include an empty white to white transition to avoid flashing the background when it is white, and it includes the F-transition and T-transition required for dark edge clearing when displaying in light mode. The special waveforms also include empty black to black transition to avoid flashing the background when it is black, and it includes the iTop Pulse and iFull pulse transitions required for light edge clearing when displaying in dark mode. With both the white to white and black to black empty transitions, both the white and black backgrounds would have reduced flashiness.

In a preferred embodiment, imaging waveform algorithms may be applied to a pixel to determine whether or not to apply a special waveform or a normal (or standard) waveform. The imaging waveform algorithms use the following data to determine whether a pixel at a location (i,j) is likely to create an edge artifact or not when displaying a combination of light mode and dark mode: 1) the location of a pixel (i,j); 2) the current graytone of pixel (i,j); 3) the next graytone of pixel (i,j); 4) the current and/or next graytones of the cardinal neighbors of pixel (i,j), where "cardinal" denotes the north, south east and west neighbors of pixel (i,j); and 5) the next graytones of the diagonal neighbors of pixel (i,j).

The SFT value range from 0 to 5 which represents zero to the maximum number of cardinal neighbors plus one. The SFT value balances the impact of the SGU transition which decreases edge artifacts but increases exposure to flashiness, which may degrade display performance. When the SFT value is zero, the maximum number of white to white pixel transitions will be made by applying the SGU transition. This maximally reduces the amount of edge artifacts but increases the risk of excessive flashiness due to the application of the SGU transition. When the SFT value is 1, 2 or 3, an intermediate number of pixels transitioning from white to white will be converted using SGU transition. These values enable the display to reduce edge artifacts, though less than a SFT value of zero, and still minimize flashiness. When the SFT value is 4, the number of white to white transitions using the SGU waveform will be minimized. The ability to reduce edge artifacts is diminished but the risk of excessive flashiness is the smallest. When the SFT value is 5, the SGU waveform is disabled and not applied to reduce edge artifacts. The SFT value may be preset or may be determined by the controller.

SIT values have the same definition as described above in reference to the iFull Pulse.

In the first version of the imaging algorithm ("Version A"), edge regions are assigned for all pixels(i,j) according to the following rules, in any order unless stated: a) if the pixel graytone transition is not white-to-white and is not black-to-black, apply the normal waveform, i.e., apply the waveform for the relevant transition for whatever drive scheme is being used; b) if the pixel graytone transition is white-to-white and at least SFT cardinal neighbors are not making a graytone transition from white-to-white, apply the SGU transition (or F-Transition); c) if the pixel graytone transition is white-to-white and all four cardinal neighbors have a next graytone of white and at least one cardinal neighbor has a current graytone that is not white, apply the BPP transition (or T-Transition); d) if the pixel graytone transition white-to-white and rules a-c do not apply, apply the light mode GL transition (i.e., white-to-white null transition); e) if the pixel graytone transition is black-to-black, and at least SIT cardinal neighbors are not making a graytone transition from black-to-black, apply the iFull Pulse transition; f) if the pixel graytone transition is black-to-black, and at least one cardinal neighbor has a current graytone not black, apply the iTop Pulse transition; or g) if the pixel graytone transition is black-to-black and rules e-f do not apply, apply the dark mode GL transition i.e., black-to-black null transition).

In the second version of the imaging algorithm ("Version B"), edge regions are assigned for all pixels(i,j) according to the following rules, in any order unless stated: a) if the pixel graytone transition is not white-to-white and is not black-to-black, apply the normal transition; b) if the pixel graytone transition is white-to-white, and at least SFT cardinal neighbors are not making a graytone transition from white-to-white, apply the SGU transition; c) if the pixel graytone transition is white-to-white, and all four cardinal neighbors have a next graytone of white and at least one cardinal neighbor has a current graytone not white, apply the BPP transition; d) if the pixel graytone transition is white-to-white and rules a-c do not apply, apply the light mode GL white-to-white null transition; e) if the pixel graytone transition is black-to-black and at least SIT cardinal neighbors are not making a graytone transition from black-to-black, apply the iFull Pulse transition; f) if the pixel graytone transition is black-to-black and at least one cardinal neighbor has a current graytone not black and a next graytone of black, apply the iTop Pulse transition; or g) if the pixel graytone transition is black-to-black and rules e-f do not apply, apply the dark mode GL black-to-black null transition.

In the third version of the imaging algorithm ("Version C"), edge regions are assigned for all pixels(i,j) according to the following rules, in any order unless stated: a) if the pixel graytone transition is not white-to-white and is not black-to-black, apply the normal transition; b) if the pixel graytone transition is white-to-white and at least SFT cardinal neighbors are not making a graytone transition from white-to-white, apply the SGU transition; c) if the pixel graytone transition is white-to-white and all four cardinal neighbors have a next graytone of white and at least one cardinal neighbor has a current graytone not white, apply the BPP transition; d) if the pixel graytone transition is white-to-white and rules a-c do not apply, apply the light mode GL white-to-white null transition; e) if the pixel graytone transition is black-to-black and at least SIT cardinal neighbors are not making a graytone transition from black-to-black, apply the iFull Pulse transition; f) if the pixel graytone transition is black-to-black and all four cardinal neighbors have a next graytone of black and at least one cardinal neighbor has a current graytone not black, apply the iTop Pulse transition; or g) if the pixel graytone transition is black-to-black and rules e-f do not apply, apply the dark mode GL black-to-black null transition.

In the fourth version of the imaging algorithm ("Version D"), edge regions are assigned for all pixels(i,j) according to the following rules, in any order unless stated: a) if the pixel graytone transition is not white-to-white and is not black-to-black, apply the normal transition; b) if the pixel graytone transition is white-to-white and at least SFT cardinal neighbors are not making a graytone transition from white-to-white, apply the SGU transition; c) if the pixel graytone transition is white-to-white and all four cardinal neighbors have a next graytone of white and at least one cardinal neighbor has a current graytone not white, apply the BPP transition; d) if the pixel graytone transition is white-to-white and rules a-c do not apply, apply the light mode GL white-to-white null transition; e) if the pixel graytone transition is black-to-black and at least SIT cardinal neighbors are not making a graytone transition from black-to-black, apply the iFull Pulse transition; f) if the pixel graytone transition is black-to-black and all four cardinal and diagonal neighbors have a next graytone of black and at least one cardinal neighbor has a current graytone not black, apply the iTop Pulse transition; or g) if the pixel graytone transition is black-to-black and rules e-f do not apply, apply the dark mode GL black-to-black null transition.

In all four versions of the imaging algorithm, Versions A-D, the BPP transition may be replaced with the light mode top-off pulse and, as necessary, remnant voltage discharging.

Another aspect of the present invention relates to drift compensation, which compensates for changes in the optical state of an electro-optic display with time and is described for light mode displaying in aforementioned WO 2015/017624. This drift compensation algorithm may be applied inversely for dark mode displaying. As already noted, electrophoretic and similar electro-optic displays are bistable. However, the bistability of such displays is not unlimited in practice, a phenomenon known as image drift occurs, whereby pixels in or near extreme optical states tend to revert very slowly to intermediate gray levels; for example, black pixels gradually become dark gray and white pixels gradually become light gray. The dark state drift is of interest when displaying in dark mode. If an electro-optic display is updated using a global limited drive scheme (where pixels in the background dark state are driven with null transitions) for long periods of time without a full display refresh, the dark state drift becomes an essential part of the overall visual appearance of the display. Over time, the display will show areas of the display where the dark state has been recently rewritten and other areas such as the background where the dark state has not recently been rewritten and has thus been drifting for some time. Typical dark state drift has a range around 0.5L* to >2L* where most of the dark state drift is occurs within 10 seconds to 60 seconds. This results an optical artifact known as ghosting, whereby the display shows traces of previous images. Such ghosting effects are sufficiently annoying to most users that their presence a significant part in preventing the use of global limited drive schemes exclusively for long periods of time.

Drift compensation provides a method of driving a bistable electro-optic display having a plurality of pixels each capable of displaying two extreme optical states, the method comprising: writing a first image on the display; writing a second image on the display using a drive scheme in which a plurality of background pixels which are in the same extreme optical state in both the first and second images are not driven; leaving the display undriven for a period of time, thereby permitting the background pixels to assume an optical state different from their extreme optical state; after said period of time, applying to a first non-zero proportion of the background pixels a refresh pulse which substantially restores the pixels to which it is applied to their extreme optical state, said refresh pulse not being applied to the background pixels other than said first non-zero proportion thereof; and thereafter, applying to a second non-zero minor proportion of the background pixels different from the first non-zero proportion a refresh pulse which substantially restores the pixels to which it is applied to their extreme optical state, said refresh pulse not being applied to the background pixels other than said second non-zero proportion thereof In a preferred form of this drift compensation method for dark mode, the display is provided with a timer which establishes a minimum time interval (for example, preferably about 3 seconds, but it may be about 10 seconds or as long as about 60 seconds) between successive applications of the refresh pulses to differing non-zero proportions of the background pixels. As already indicated, the drift compensation method will typically be applied to background pixels in the black extreme optical state, or when displaying a combination of light mode and dark mode, in both extreme optical states. The drift compensation method may of course be applied to both monochrome and gray scale displays.

The drift compensation method for dark mode may be regarded as a combination of a specially designed waveform with an algorithm and a timer to actively compensate for the background dark state drift as seen in some electro-optic and especially electrophoretic displays. The special iTop Pulse waveform is applied to selected pixels in the background dark state when a triggering event occurs that is typically based on a timer in order to drive the dark state reflectance down slightly in a controlled manner. The purpose of this waveform is to slightly decrease the background dark state in a way that is essentially invisible to the user and therefore non-intrusive. The drive voltage of the iTop Pulse may be modulated (for example 10V instead of the 15V used in other transitions) in order to control the amount of dark state decrease. Further, a designed pixel map matrix (PMM) may be used to control the percentage of the pixels receiving the iTop Pulse when applying drift compensation.

Drift compensation is applied by requesting a special update to the image currently displayed on the display. The special update calls a separate mode storing a waveform that is empty for all transitions, except for the special iTop Pulse transition. The drift compensation method very desirable incorporates the use of a timer. The special iTop Pulse waveform used results in a decrease in the background dark state lightness. A timer may be used in the drift compensation method in several ways. A timeout value or timer period may function as an algorithm parameter; each time the timer reaches the timeout value or a multiple of the timer period, it triggers an event that requests the special update described above and resets the timer in the case of the timeout value. The timer may be reset when a full screen refresh (a global complete update) is requested. The timeout value or timer period may vary with temperature in order to accommodate the variation of drift with temperature. An algorithm flag may be provided to prevent drift compensation being applied at temperatures at which it is not necessary.

Another way of implementing drift compensation is to fix the timer period, for example, at every 3 seconds, and make use of the algorithm PMM to provide more flexibility as to when the iTop Pulse is applied. Other variations may include using the timer information in conjunction with the time since the last user-requested page turn. For example, if the user has not requested page turns for some time, application of iTop Pulses may cease after a predetermined maximum time. Alternatively, the iTop Pulse could be combined with a user-requested update. By using a timer to keep track of the elapsed time since the last page turn and the elapsed time since the last application of a top-off pulse, one could determine whether to apply a iTop Pulse in this update or not. This would remove the constraint of applying this special update in the background, and may be preferable or easier to implement in some cases.

As indicated previously, the dark state drift correction may be tuned by a combination of the pixel map matrix, the timer period, and the drive voltage, iTop size and iTop pad for the iTop Pulse. As already mentioned, the use of DC imbalanced waveforms, such as the iTop Pulse, is known to have the potential to cause problems in bistable displays; such problems may include shifts in optical states over time that will cause increased ghosting, and in extreme cases may cause the display to show severe optical kickback and even to stop functioning. This is believed to be related to the build-up of a remnant voltage or residual charge across the electro-optic layer. Performing remnant voltage discharging (post-drive discharging as described in aforementioned U.S. application Ser. No. 15/014,236) in combination with DC imbalance waveforms allows for improved performance without reliability issues and enables the use of more DC imbalance waveforms.

Figure 13:
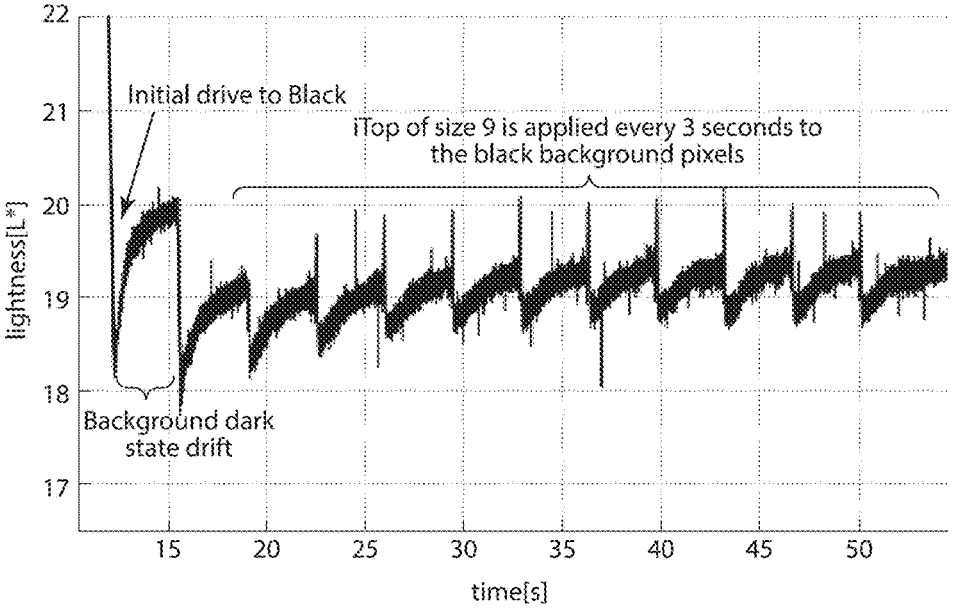
FIG. 13 is a graphical representation that measures dark state drift over time without drift compensation and with drift compensation.

FIG. 13 is a graphical representation of dark state drift over time where, after the first 15 seconds, an iTop Pulse is applied every 3 seconds to compensate for the drift. The dark state drift is measured by lightness in L*. The iTop Pulse of size 9 is applied every 3 seconds along with applying a post-drive discharging. As is shown, the overall dark state drift is reduced.

It should be understood that the various embodiments shown in the Figures are illustrative representations, and are not necessarily drawn to scale. Reference throughout the specification to "one embodiment" or "an embodiment" or "some embodiments" means that a particular feature, structure, material, or characteristic described in connection with the embodiment(s) is included in at least one embodiment, but not necessarily in all embodiments. Consequently, appearances of the phrases "in one embodiment," "in an embodiment," or "in some embodiments" in various places throughout the Specification are not necessarily referring to the same embodiment.

Unless the context clearly requires otherwise, throughout the disclosure, the words "comprise," "comprising," and the like are to be construed in an inclusive sense as opposed to an exclusive or exhaustive sense; that is to say, in a sense of "including, but not limited to." Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list; all of the items in the list; and any combination of the items in the list.

Having thus described several aspects of at least one embodiment of the technology, it is to be appreciated that various alterations, modifications, and improvements will readily occur to those skilled in the art. Such alterations, modifications, and improvements are intended to be within the spirit and scope of the technology. Accordingly, the foregoing description and drawings provide non-limiting examples only.

The invention claimed is:

1. A method of driving an electro-optic display having a plurality of pixels and displaying in dark mode, the method comprising:

identifying a pixel undergoing a black-to-black transition having at least one cardinal neighbor pixel undergoing an active transition;

applying to the pixel a top-off pulse having a polarity which drives the pixel towards its black state, and applying a remnant voltage discharging algorithm.

2. The method of claim 1, wherein the at least one cardinal neighbor undergoing an active transition has a current graytone that is not black.

3. The method of claim 1, wherein the at least one cardinal neighbor undergoing an active transition has a current graytone that is not black and a next graytone of black.

4. The method of claim 1, wherein all four cardinal neighbors of the pixel undergoing a black-to-black transition have a next graytone of black and at least one cardinal neighbor has a current graytone that is not black.

5. The method of claim 1, wherein all four cardinal and four diagonal neighbors of the pixel undergoing a black-to-black transition have a next graytone of black and at least one cardinal neighbor has a current graytone that is not black.

6. The method of claim 1, wherein the electro-optic display is an electrophoretic display.

7. The method of claim 1, wherein the electro-optic display is an electrophoretic display.

8. A method of driving an electro-optic display having a plurality of pixels and displaying in dark mode, the method comprising:

identifying a pixel undergoing a black-to-black transition having at least one cardinal neighbor pixel not transitioning from black-to-black; and applying to the pixel a first drive pulse having a polarity which drives the pixel towards its white state and a second drive pulse having a polarity which drives the pixel towards its black state, wherein the first drive pulse and second drive pulse together are DC imbalanced.

9. The method of claim 8, wherein the pixel undergoing a black-to-black transition has at least two cardinal neighbor pixels not transitioning from black-to-black.

10. The method of claim 8, wherein the pixel undergoing a black-to-black transition has at least three cardinal neighbor pixels not transitioning from black-to-black.

11. The method of claim 8, wherein the pixel undergoing a black-to-black transition has all four cardinal neighbor pixels not transitioning from black-to-black.

12. The method of claim 8, wherein the electro-optic display is an electrophoretic display.

13. The method of claim 8, further comprising:

applying a remnant voltage discharging algorithm.

14. The method of claim 13, wherein the electro-optic display is an electrophoretic display.

15. A method of driving an electro-optic display having a plurality of pixels and displaying in dark mode, the method comprising:

identifying a pixel undergoing a black-to-black transition; and applying to the pixel a first drive pulse having a polarity which drives the pixel towards its white state and a second drive pulse having a polarity which drives the pixel towards its black state, wherein the first drive pulse and second drive pulse together are DC imbalanced.

* * * * *